US012507764B2

(12) United States Patent
Stepanian et al.

(10) Patent No.: US 12,507,764 B2
(45) Date of Patent: Dec. 30, 2025

(54) FOOTWEAR CONFIGURATIONS

(71) Applicant: BOA Technology, Inc., Denver, CO (US)

(72) Inventors: Matt Stepanian, Denver, CO (US); Matt Zwiesler, Denver, CO (US); Melissa Norrish, Denver, CO (US); Hannah McDermott, Denver, CO (US); Andrea Kilness, Denver, CO (US); Kevin Chen, Denver, CO (US); Anna Hetman, Denver, CO (US)

(73) Assignee: BOA Technology, Inc., Denver, CO (US)

( * ) Notice: Subject to any disclaimer, the term of this patent is extended or adjusted under 35 U.S.C. 154(b) by 129 days.

(21) Appl. No.: 18/344,601

(22) Filed: Jun. 29, 2023

(65) Prior Publication Data

US 2024/0000196 A1 Jan. 4, 2024

Related U.S. Application Data

(60) Provisional application No. 63/430,457, filed on Dec. 6, 2022, provisional application No. 63/425,946, filed on Nov. 16, 2022, provisional application No. 63/357,523, filed on Jun. 30, 2022.

(51) Int. Cl.
*A43C 11/16* (2006.01)
*A43C 11/00* (2006.01)

(52) U.S. Cl.
CPC ..... *A43C 11/165* (2013.01); *A43C 11/008* (2013.01)

(58) Field of Classification Search
CPC . A43C 11/008; A43C 11/004; A43C 11/1493; A43C 11/165; A43B 11/00
See application file for complete search history.

(56) References Cited

U.S. PATENT DOCUMENTS

| | | | | | |
|---|---|---|---|---|---|
| 737,769 | A | * | 9/1903 | Preston | A43C 11/165 242/379.2 |
| 1,505,430 | A | * | 8/1924 | Roberts | A43C 3/02 24/715.1 |
| 1,995,243 | A | * | 3/1935 | Clarke | A43C 1/00 24/713.3 |
| 2,369,254 | A | * | 2/1945 | Roman | A43C 1/04 36/50.1 |
| 3,333,304 | A | * | 8/1967 | Daddona, Jr. | A43C 5/00 24/715.2 |

(Continued)

FOREIGN PATENT DOCUMENTS

WO 2020/139463 A1 7/2020

*Primary Examiner* — Ted Kavanaugh
(74) *Attorney, Agent, or Firm* — Kilpatrick Townsend & Stockton LLP

(57) ABSTRACT

An article of footwear, such as a shoe or boot, includes a sole, an upper, and one or more guides that are coupled or attached with the upper. The one or more guides are configured and arranged to route or direct a tension member along a path about the footwear. The footwear also includes a panel having a fixed end that is attached to a first side of the upper and a free end that is positioned opposite the fixed end. The panel extends from the first side of the upper toward a second side of the upper. The panel is positionable over at least one guide of the one or more guides to cover and conceal the at least one guide from external view.

17 Claims, 11 Drawing Sheets

(56) References Cited

U.S. PATENT DOCUMENTS

| | | | | |
|---|---|---|---|---|
| 4,845,864 | A * | 7/1989 | Corliss | A43B 5/14 36/131 |
| 7,370,440 | B1 | 5/2008 | Cole, III | |
| 9,259,056 | B2 | 2/2016 | Soderberg et al. | |
| 11,439,201 | B2 * | 9/2022 | Hatfield | A43B 23/027 |
| D965,257 | S * | 10/2022 | Hammerslag | D2/978 |
| 2005/0178026 | A1 | 8/2005 | Friton | |
| 2018/0160764 | A1 * | 6/2018 | Garneau | A43B 23/0205 |
| 2019/0200706 | A1 * | 7/2019 | Huang | A43C 1/00 |
| 2023/0148712 | A1 * | 5/2023 | Ouchi | A43C 1/003 24/68 SK |

* cited by examiner

FOOTWEAR CONFIGURATIONS

CROSS-REFERENCE TO RELATED APPLICATIONS

This application claims priority to Provisional U.S. Patent Application No. 63/357,523 filed Jun. 30, 2022, entitled "Footwear Configurations;" Provisional U.S. Patent Application No. 63/425,946 filed Nov. 16, 2022, entitled "Footwear Configurations;" and Provisional U.S. Patent Application No. 63/430,457 filed Dec. 6, 2022, entitled "Footwear Configurations." The entire disclosure of all of the aforementioned Provisional U.S. patent applications are hereby incorporated by reference, for all purposes, as if fully set forth herein.

BACKGROUND

The present disclosure is related to reel based closure devices and footwear that employs a reel based closure device. Footwear typically includes some closure system, which allows the footwear to be placed about a wearer's foot and closed or tightened about the foot. The closure systems are typically used to maintain or secure the footwear about the foot. For example, shoes are typically placed over a wearer's foot and shoelace is tensioned and tied to close and secure the shoe about the foot. Conventional closure systems have been modified in an effort to increase the fit and/or comfort of the footwear about the foot. For example, shoe lacing configurations and/or patterns have been modified in an attempt to increase the fit and/or comfort of wearing shoes. Conventional closure systems have also been modified in an effort to decrease the time in which the footwear may be closed and secured about the foot. These modifications have resulted in the use of various pull cords, straps, and tensioning devices that enable the footwear to be quickly closed and secured to the foot.

BRIEF DESCRIPTION

The embodiments described herein relate to articles of footwear that include a panel systems that are designed for closing and tightening the footwear about a wearer's foot. The panel systems include at least one panel that overlaps the tongue portion of the shoe. According to one aspect, an article of footwear includes a sole, an upper that is coupled with the sole, a tension member, one or more guides that are coupled with the upper, and a tightening mechanism that is operably coupled with the tension member such that an operation of the tightening mechanism tensions the tension member. The one or more guides are configured and arranged to route or direct the tension member along a path about the footwear. The footwear also includes a panel having a fixed end that is attached to a first side of the upper, a main body that extends across a top of the upper toward a second side of the upper, and a free end that is opposite the fixed end. The panel is positionable over at least one guide of the one or more guides and over the tightening mechanism to cover and conceal the at least one guide and the tightening mechanism from external view.

The footwear also typically includes at least one panel guide that is attached to an inner surface of the panel. The at least one panel guide is configured and arranged to route or direct the tension member along the path about the footwear. The at least one panel guide may be arranged so that when the tension member is tensioned, the at least one panel guide pulls the panel into contact with a tongue or throat of the footwear. The at least one panel guide may be positioned on the main body of the panel so that the free end of the panel is free of a guide for the tension member—i.e., the free end of the panel does not include a tension member guide. The at least one panel guide may be attached to the panel so that the at least one panel guide is positioned on the first side of the upper while the free end of the panel is positioned near the sole on the second side of the upper.

The one or more guides may be a guide member that is folded along a longitudinal length to form a loop or channel within which the tension member is insertable. The free end of the panel may be releasably couplable with the upper, such as by using hook and loop fasteners, magnets, snaps, clips, or other mechanical fasteners.

According to another aspect, an article of footwear includes a sole, an upper, one or more guides that are coupled with the upper, and a panel. The one or more guides are configured and arranged to route or direct a tension member along a path about the footwear. The panel has a fixed end that is attached to a first side of the upper and a free end that is opposite the fixed end. The panel extends from the first side of the upper toward a second side of the upper. The panel is positionable over at least one guide of the one or more guides to cover and conceal the at least one guide from external view.

The one or more guides may be a guide member that is folded along a longitudinal length to form a loop or channel within which the tension member is insertable. The article of footwear typically also includes a tightening mechanism that is operably coupled with the tension member such that an operation of the tightening mechanism tensions the tension member. In such instances, the panel may be positionable over the tightening mechanism to cover and conceal the tightening mechanism from external view. The article of footwear may also include an additional panel having a fixed end that is attached to the upper and a free end that is opposite the fixed end. In such instances, the panel may be positionable over the additional panel to cover and conceal at least a portion of the additional panel from external view. The free end of the panel may also be releasably couplable with the upper.

The article of footwear may further include at least one panel guide that is attached to an inner surface of the panel. The at least one panel guide may be configured and arranged to route or direct the tension member along the path about the footwear. The at least one panel guide may be attached to the panel so that the at least one panel guide is positioned on the first side of the upper while the free end of the panel is positioned near the sole on the second side of the upper. The at least one panel guide may be arranged so that when the tension member is tensioned, the at least one panel guide pulls the panel into contact with a tongue or throat of the footwear.

According to another aspect, a method of manufacturing an article of footwear includes providing an article of footwear that includes a sole and an upper. The method also includes coupling one or more guides with the upper so that the one or more guides are configured and arranged to route or direct a tension member along a path about the footwear. The method further includes coupling a panel with a first side of the upper, the panel being oriented about the upper so that: a distal end of the panel extends atop the upper toward a second side of the upper and the panel is positionable atop the one or more guides to cover and conceal the one or more guides from external view.

The one or more guides may be a guide member that is folded along a longitudinal length to form a loop or channel.

In such instances, the method may additionally include inserting the tension member through the loop or channel of the guide member. An additional method step may include attaching one or more panel guides to an inner surface of the panel and/or attaching a tightening mechanism to the upper. In the latter instance, the tightening mechanism is operably coupled with the tension member such that an operation of the tightening mechanism tensions the tension member. The tightening mechanism may be positioned such that the panel is positionable over the tightening mechanism to cover and conceal the tightening mechanism from external view. A distal end of the panel may be releasably couplable with the upper.

BRIEF DESCRIPTION OF THE DRAWINGS

The present invention is described in conjunction with the appended figures.

Figure 1A:
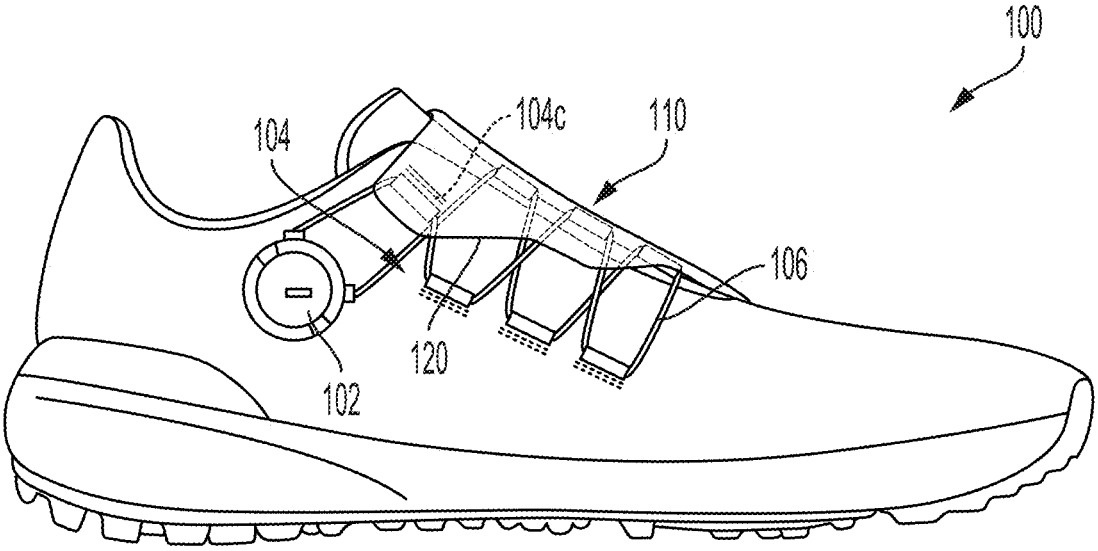
FIGS. 1A-B illustrate a first embodiment of an article of footwear having a panel system and tightening mechanism.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The embodiments herein describe panel systems that are designed for closing and tightening an article of footwear, such as a shoe, about a wearer's foot. The panel systems include at least one panel, and commonly at least two panels, that overlap the tongue portion of the shoe. The overlapping panel(s) also overlap one or more components of a tightening system. The tightening system includes a tension member, one or more guides that guide or route the tension member along the footwear, and a tightening mechanism that is operable to tension the tension member and thereby tighten the footwear. The panel(s) may overlap the tension member, one or more guides, and/or the tightening mechanism.

In a specific embodiment, the panel system includes or consists of a pair of panels. In such embodiments, a lower panel is positioned closer to the foot while an upper panel is positioned above or atop the lower panel. The lower panel is typically laterally smaller and/or longitudinally shorter than the upper panel. The lower panel may only extend past a dorsal ridge of the foot. The lower panel may be positioned below the shoe's tongue, so as to be closer to the foot, or may be positioned above the tongue as desired. The use of the lower panel may provide an increased sensation of fit of the article of footwear about a wearer's foot, especially when the lower panel is positioned under the tongue. The upper panel is typically laterally larger or wider and/or is longitudinally longer than the lower panel. In such embodiments, the upper panel may entirely, or partially, cover and conceal the lower panel. Covering the lower panel may provide a cleaner and simpler visual aesthetic.

The lower and upper panels are commonly made of flexible and soft materials, such as fabric materials. However, in some embodiments, one or both panels may be made of a rigid or semi-rigid material, such as plastic. In such embodiments, the upper panel is more commonly made of a rigid or semi-rigid material while the lower panel remains relatively flexible. The tightening system may be a reel based closure device, a pull cord system, conventional lacing system, and the like. The tightening mechanism may be positioned at various locations on the footwear, such as on the tongue, on a side of the footwear, on a heel of the footwear, or on the upper or lower panel. For convenience in describing the various embodiments, the tightening mechanism is illustrated as being positioned on the side of the footwear, although it should be understood that positioning the tightening mechanism elsewhere on the footwear (i.e., on the tongue, heel, upper panel, or lower panel) is contemplated and intended to be included in any of the described embodiments.

In a specific embodiment, the tightening system is a reel based closure device. The reel based closure device includes a knob or dial that may be grasped and rotated by the wearer. The knob or dial is coupled with a spool around which the tension member or lace is wound in response to rotation of the knob or dial in a tightening direction. Rotation of the tension member/lace around the spool tensions the tension member/lace, which tightens the article of footwear about the wearer's foot by pulling the upper, and any interior padding, into increased contact with the wearer's foot. Exemplary reel based closure devices are further described in U.S. patent application Ser. No. 14/297,047 filed Jun. 5, 2017, and entitled "Integrated Closure Device Components and Methods", and in U.S. Pat. No. 9,259,056, filed Jun. 21, 2013, and entitled "Reel Based Lacing System", the entire disclosures of which are incorporated by reference herein.

Figure 1B:
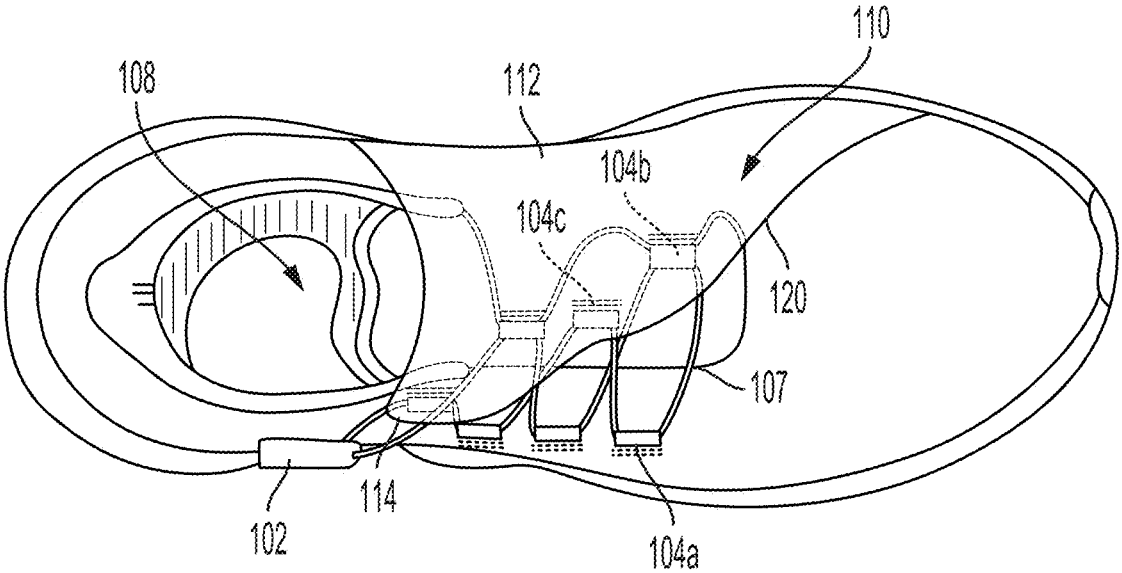

Referring to FIGS. 1A-B, illustrated is an article of footwear 100, which in the illustrated embodiment is a shoe (hereinafter footwear 100 or shoe 100). The shoe 100 includes a tightening mechanism 102, which in the illustrated embodiment is a reel based closure device (hereinafter reel based closure device 102). The reel based closure device 102 is positioned on the side of the shoe 100 and is operably coupled with a tension member or lace 106 (hereinafter tension member 106). The tension member 106 is routed or guided along a path about the shoe 100 via a plurality of guides 104—i.e., guides 104*a*, 104*b*, and 104*c*. The path of the tension member 106 traverses between an opening 108 of the shoe 100 and between guides (104*a*, 104*b*, and 104*c*) that are positioned on opposing sides of the opening 108. One or more guides 104*a* are attached to the upper of the shoe 100. The guides 104*a* may be positioned near an eyestay of the shoe 100, near a sole of the shoe 100, or closer to a midpoint between the eyestay and sole of the shoe 100.

The shoe 100 includes a lower panel 110 that is coupled or fixed with a first side 112 of the shoe (e.g., the medial side) and that extends upward toward a second side 114 of the shoe 100. The lower panel 110 extends at least partially over the opening 108 of the shoe 100 and commonly to the dorsal ridge of the foot. In the illustrated embodiment, the lower panel 110 extends to near a centerline of the shoe 100, although in other embodiments, the lower panel 110 may not extend to the centerline or may extend substantially farther than the centerline. The lower panel 110 may be positioned under the upper of the shoe 100 or may be positioned atop the upper as desired. The lower panel 110 may be formed of a continuous panel segment as illustrated in FIGS. 1A-B or may be formed of multiple panel segments or straps. In such embodiments, the shoe 100 may include three or more panels. A distal edge of the lower panel 110 may have or define a linear or straight edge or may have a non-linear edge as illustrated in FIGS. 1A-B.

One or more guides 104*b* are coupled with the lower panel 110. The guides 104*b* may be coupled with a main body of the lower panel 110 and/or attached to the distal edge of the lower panel 110. The tension member 106 is routed through the one or more guides 104*b* of the lower panel 110. Tensioning of the tension member 106 causes the tension member 106 to pull on the one or more guides 104*b* of the lower panel 110, which pulls the lower panel 110 toward the second side 114 of the shoe 100 and increases the fit of the shoe 100 about the wearer's foot.

The shoe 100 also includes an upper panel 120 that is coupled or fixed with the first side 112 of the shoe and that extends toward the second side 114 of the shoe 100. In the illustrated embodiment, the upper panel 120 extends across the shoe 100 in the same direction as the lower panel 110. In other embodiments, the upper panel 120 may extend across the shoe 100 in a direction that is opposite to the lower panel 110.

The upper panel 120 extends at least partially over the opening 108 of the shoe 100. In the illustrated embodiment, the upper panel 120 extends fully over the lower panel 110 and covers a majority or entirety of the shoe's tongue. The upper panel 120 has a lateral width that is greater than the lower panel 110, in which the lateral width is measured in a direction across the shoe from the medial side to the lateral side. The upper panel 120 also has a longitudinal length that is greater or longer than the lower panel 110, in which the longitudinal length is measured in a direction from the shoe's heel to the toe box. The greater lateral width and longitudinal length of the upper panel 120 allows the upper panel 120 to entirely cover and conceal the lower panel 110. In some embodiments, the lateral width and/or longitudinal length of the upper panel 120 is less than the corresponding width or length of the lower panel 110. In such embodiments, a portion of the lower panel 110 may be visible from under the upper panel 120, which may provide a desired visual appearance.

The upper panel 120 typically extends to beyond the centerline of the shoe 100, although in some embodiments, the upper panel 120 may extend to near the centerline or may not extend to the centerline at all. The upper panel 110 is typically formed of a continuous panel segment as illustrated in FIGS. 1A-B, but in some instance, the upper panel 120 may be formed of multiple panel segments or straps. In such embodiments, the multiple panel segments or straps may fully or partially cover the lower panel 110. A distal edge of the upper panel 120 may define a roughly linear, straight, or smooth edge. In other embodiments, the distal edge of the upper panel 120 may be non-linear shaped. In the illustrated embodiments, the distal edge may run or extend diagonally over the tongue of the shoe 100.

One or more guides 104*c* are coupled with the upper panel 120. The guides 104*c* are typically coupled with an inner surface of the upper panel 120 so that when the upper panel 120 is closed about the shoe 100, the guides 104*c* are hidden from view. In other embodiments, one guide of the one or more guides 104*c*, or a plurality of such guides, may be coupled with the outer surface of the upper panel 120 so that the guide(s) are visible when the upper panel 120 is closed about the shoe 100. In the illustrated embodiment, the upper panel 120 includes two guides 104*c* that are coupled with the inner surface of the panel. The guides 104*c* include a mid-guide that is positioned toward the middle of the upper panel 120 and a top guide that is positioned closer to the heel of the shoe 100. The top guide may also be positioned on a flap or portion of the upper panel 120 that extends laterally farther than the remaining portions of the panel. The mid-guide 104*c* of the upper panel 120 may be positioned between two guides 104*b* of the lower panel. The top guide 104*c* of the upper panel 120 may be positioned closest to the heel in comparison with the other guides (104*a*, 104*b*, & 104*c*).

The tension member 106 is routed through the one or more guides 104*c* of the upper panel 120. In the illustrated embodiment, the tension member 106 is routed through alternating guides of the shoe 100 as the tension member is routed from the reel based closure device 102 toward the toe box. Specifically, the tension member is routed from the reel based closure device 102 to the top guide 104*c* of the upper panel 120 and is routed therefrom to a top guide 104*a* attached to the shoe 100. The tension member is routed from the top guide 104*a* of the shoe 100 to the mid-guide 104*c* of the upper panel 120 and is routed therefrom to a bottom guide 104*a* of the shoe 100. The tension member is then routed from the bottom guide 104*a* to a lower guide 104*b* of the lower panel 110 and is routed therefrom to a mid-guide 104*a* of the shoe 100. The tension member is finally routed from the mid-guide 104*a* of the shoe 100 to an upper guide 104*b* of the lower panel 110 and is routed therefrom to the reel based closure device 102.

Tensioning the tension member 106 causes the tension member 106 to pull on the one or more guides 104*c* of the upper panel 120 toward the second side 114 of the shoe 100 and pulls the upper panel 120 over the lower panel 110. As mentioned herein, tensioning the tension member 106 also tensions the lower panel 110. In this manner, the tension member 106 and reel based closure device 102 may be employed to simultaneously tension the lower panel 110 and the upper panel 120.

The guides (104, 104B, & 104C) may be formed of rigid, semi-rigid, or flexible materials. In one embodiment, one or more of the guides (104, 104B, & 104C) may be formed of a fabric material that is folded to form a loop or channel through which the tension member 106 is inserted. In other embodiments, one or more of the guides (104, 104B, & 104C) may be formed of more rigid materials, such as plastic materials, metal materials, and the like.

Figure 2A:
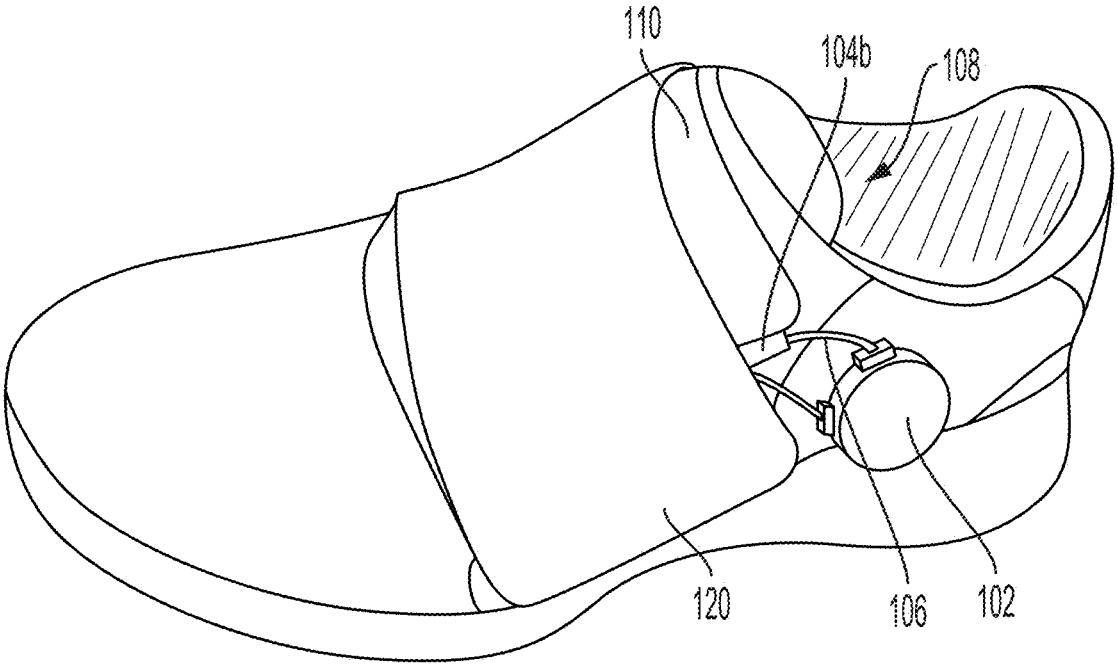
FIGS. 2A-B illustrate a second embodiment of an article of footwear having a panel system and tightening mechanism.
Figure 2B:
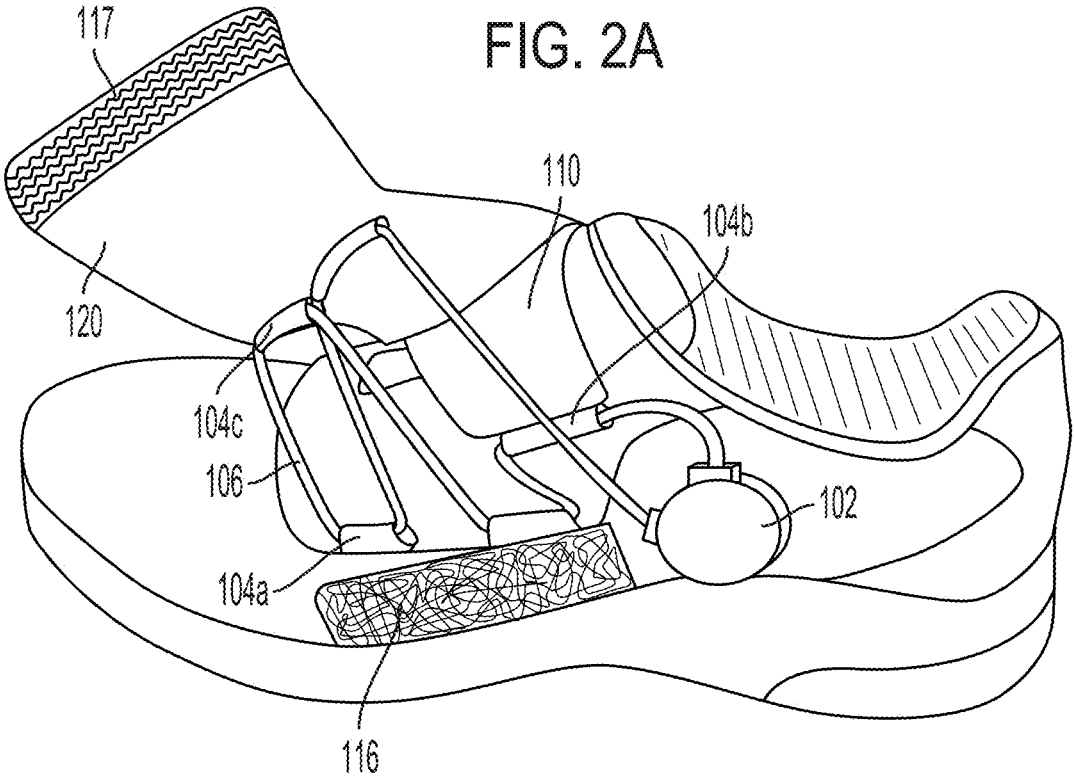

Referring to FIGS. 2A-B, illustrated is another embodiment of a shoe 100 that includes a panel system. The panel system of FIGS. 2A-B is similar to the panel system of FIGS. 1A-B and similar reference numerals have been used to refer to similar components of the two-panel system. As such, the description of FIGS. 1A-B is equally applicable to the description of FIGS. 2A-B, but for purposes of brevity, the description is omitted for the description of FIGS. 2A-B.

A difference between the two systems is in the position of the upper panel 120 and lower panel 110 about the shoe 100 and in the orientation of the panels over the upper portion of the shoe 100. For example, the lower panel 110 includes a single guide 104*b* (although additional guides could be employed) and the distal edge of the lower panel 110 is roughly linear or straight. The lower panel 110 is designed to fit over and atop the upper portion of the wearer's foot. Tensioning of the lower panel 110, via the reel based closure device 102, causes the lower panel 110 to constrict about the upper portion of the wearer's foot. The use of the lower panel 110 provides an increased sensation of fit of the footwear about the wearer's foot. As noted herein, the lower panel 110 may be positioned under the tongue, which may increase the sensation of fit.

The upper panel 120 includes a pair of guides 104*c* (although more or fewer guides may be employed) that are positioned near a mid-point of the panel. The distal end or edge of the upper panel 120 does not include a guide. As such, tensioning the tension member 106 only pulls the middle portion of the upper panel 120 into contact with the shoe 100. Other attachment means may be employed to attach or fasten the distal end or edge of the upper panel 120 to the shoe 100. For example, the illustrated embodiment uses hook and loop fasteners, 116 and 117, that are positioned on the shoe 100 and on the distal edge of the upper panel 120. The hook and loop fasteners, 116 and 117, secure the distal end of the upper panel 120 to the shoe 100. Other fastening means, such as buttons, zippers, magnets, clips, clamps, and the like may be used to fasten or secure the distal end of the upper panel 120 to the shoe 100.

As illustrated, the distal end of the upper panel 120 extends roughly to the sole of the shoe 100. This extension of the upper panel 120 ensures that substantially all of the guides 104 of the shoe 100 are covered and concealed by the upper panel 120. The distal end of the upper panel 120 may be substantially linear as illustrated in FIGS. 2A-B. A portion of the lower panel 110 may be visible when the upper panel 120 is closed and pulled tight against the lower panel 110 and shoe 100. In the illustrated embodiment, only the reel based closure device 102, a small portion of the tension member 106, and, in some instances, a portion of the lower panel 110 may be visible when the upper panel 120 is pulled tight against the shoe 100. Exposing the reel based closure device 102 allows the reel based closure device 102 to be accessed and operated even when the upper panel 120 is pulled tight against the shoe 100.

Figure 3A:
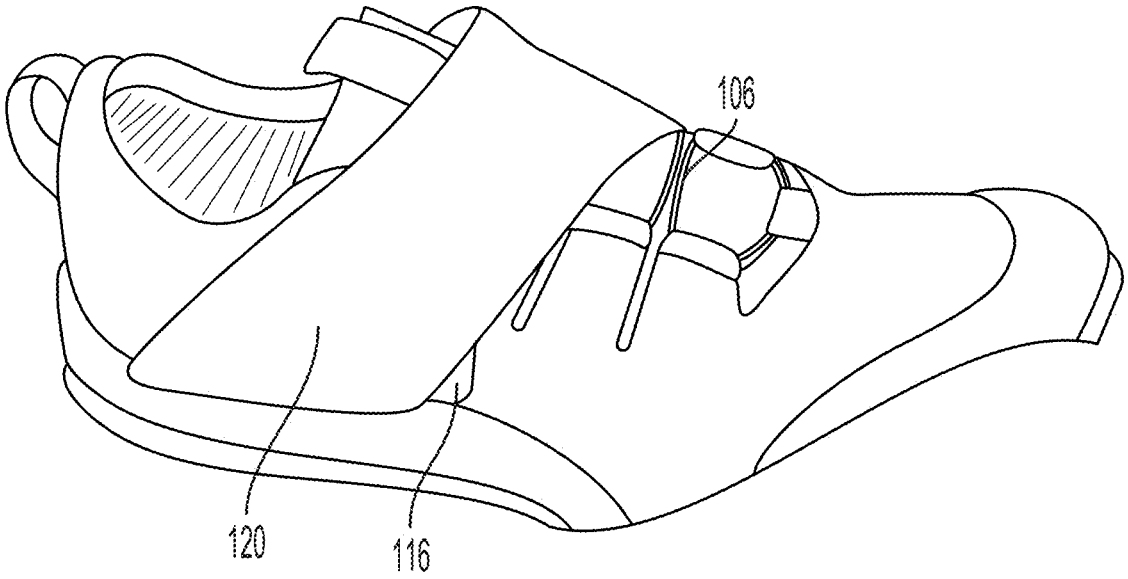
FIGS. 3A-B illustrate a third embodiment of an article of footwear having a panel system and tightening mechanism.
Figure 3B:
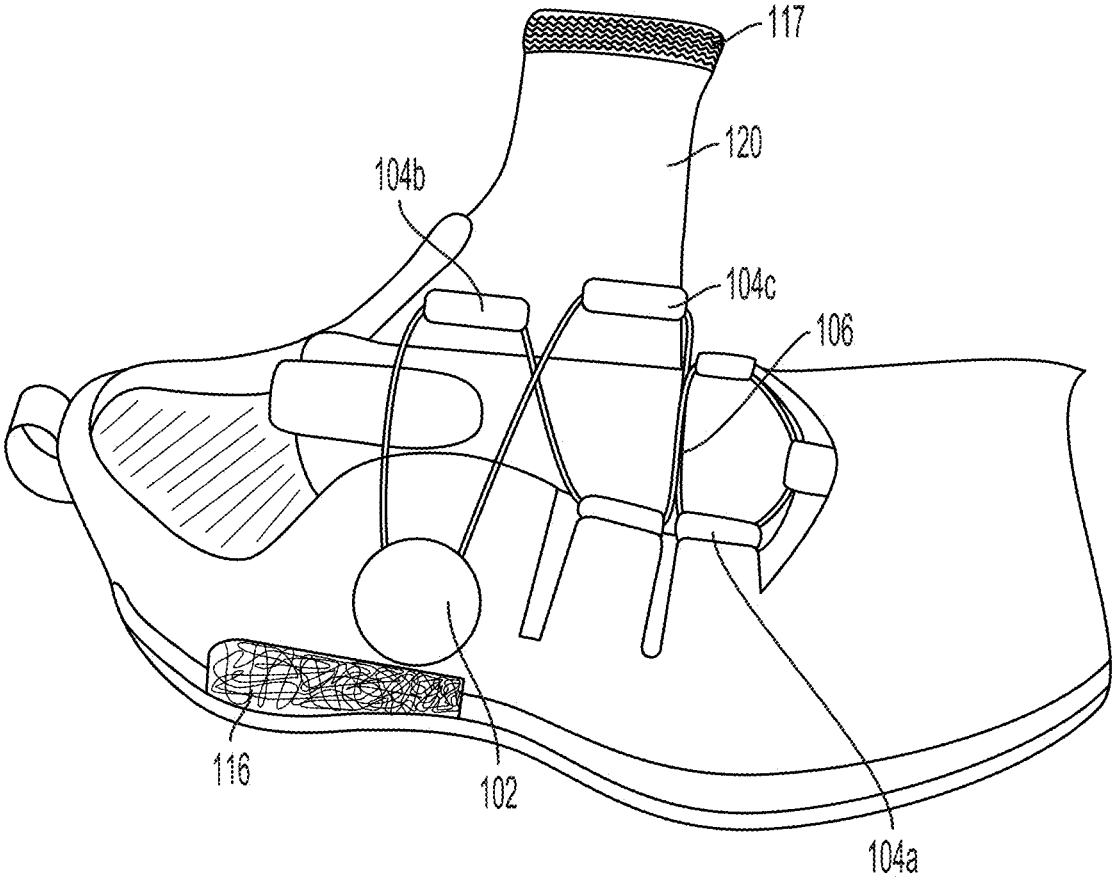

Referring to FIGS. 3A-B, illustrated is another embodiment of a shoe 100 that includes a panel system. The panel system of FIGS. 3A-B is similar to the panel systems of FIGS. 1A-B and 2A-B. Similar reference numerals have been used to refer to similar components of various panel systems. As such, the descriptions of FIGS. 1A-B and FIGS. 2A-B are equally applicable to the description of FIGS. 3A-B, but for purposes of brevity, have been omitted in describing FIGS. 3A-B.

A difference in the system of FIGS. 3A-B is in the position of the upper panel 120 and lower panel 110 about the shoe 100 and in relation to each other. For example, the lower panel 110 is substantially short and does not extend to the centerline of the shoe 100. The lower panel 110 includes a single guide 104*b* that is coupled with a distal edge of the lower panel 110. The lower panel 110 has a longitudinal length that is substantially shorter than a length of the upper panel 120. In some embodiments, the shoe 100 may not include a lower panel 110 at all. In such instances, the guide 104*b* may be attached to the inner surface of the upper panel 120. FIG. 3B represents both an embodiment in which the shoe 100 includes a lower panel 110 and in which the guide 104*b* is attached directly to the inner surface of the upper panel 120.

The upper panel 120 includes a single guide 104*c* (although more guides may be employed) that is positioned near a mid-point of the panel. In embodiments in which the shoe 100 does not include a lower panel 110, the upper panel 120 includes a pair of guides (guide 104*b* and 104*c*) that are attached to the inner surface of the panel. Similar to the panel system of FIGS. 2A-B, the distal end or edge of the upper panel 120 does not include a guide. As such, tensioning the tension member 106 only pulls the middle portion of the upper panel 120 into contact with the shoe 100. Other attachment means are employed to attach the distal end or edge of the upper panel 120 to the shoe 100, such as the hook and loop fasteners, 116 and 117, that are positioned on the shoe 100 and on the distal edge of the upper panel 120. Other fastening means may be used to fasten or secure the distal end of the upper panel 120 to the shoe 100 as previously described.

The distal end of the upper panel 120 extends roughly to the sole of the shoe 100. The distal end of the upper panel 120 may be substantially linear as illustrated in FIGS. 3A-B. In the illustrated embodiment, when the upper panel 120 is pulled tight against the shoe, the reel based closure device 102 and all of the guides (104*a-c*), or a majority of the guides (104*a-c*), are covered and concealed by the upper panel 120. As such, essentially none of the components of the panel system, or only a few of the components, are visible when the upper panel 120 is pulled tight against the shoe 100. For example, only a distal portion of the tension member path may be visible when the upper panel 120 is pulled against the shoe 100. The shape and/or size of the upper panel 120 may be modified to entirely cover and conceal the components of the panel system. The panel system of FIGS. 3A-B, and in particular the upper panel 120, may provide a smooth and visually appealing outer surface of the shoe 100.

FIGS. 4A-7C illustrate various embodiments of panel configurations and tension member paths that may be employed with articles of footwear. The various panel and/or tension member configurations may be implemented to achieve a desired level of tightening of the footwear about a wearer's foot. The illustrated panel configurations and tension member paths may be altered or combined to achieve a desired appearance and/or fit of the footwear about the wearer's foot. For example, a panel configuration of one embodiment, such as a panel that extends across the footwear near the toe box or throat, may be employed with a tension member path of a different embodiment, such as a tension member path that is routed underneath the panel or atop the upper of the footwear. In addition, for brevity in describing the various embodiments, similar reference numerals to previous embodiments have been used in describing the embodiments of FIGS. 4A-7C. It should be realized that the previous description of those components is equally applicable to the embodiments of FIGS. 4A-7C. In addition, a description of specific features or characteristics of similar components may be omitted for purposes of brevity. In such instances, however, the full description of such features or characteristics is equally applicable to the similar components.

Figure 4A:
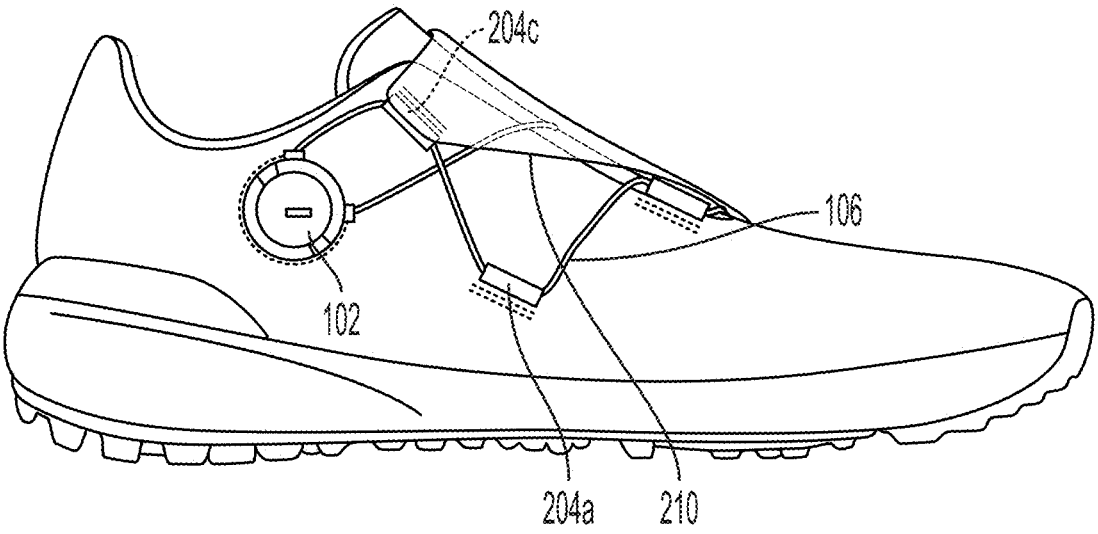
FIGS. 4A-B illustrate a fourth embodiment of an article of footwear having a panel system and tightening mechanism.
Figure 4B:
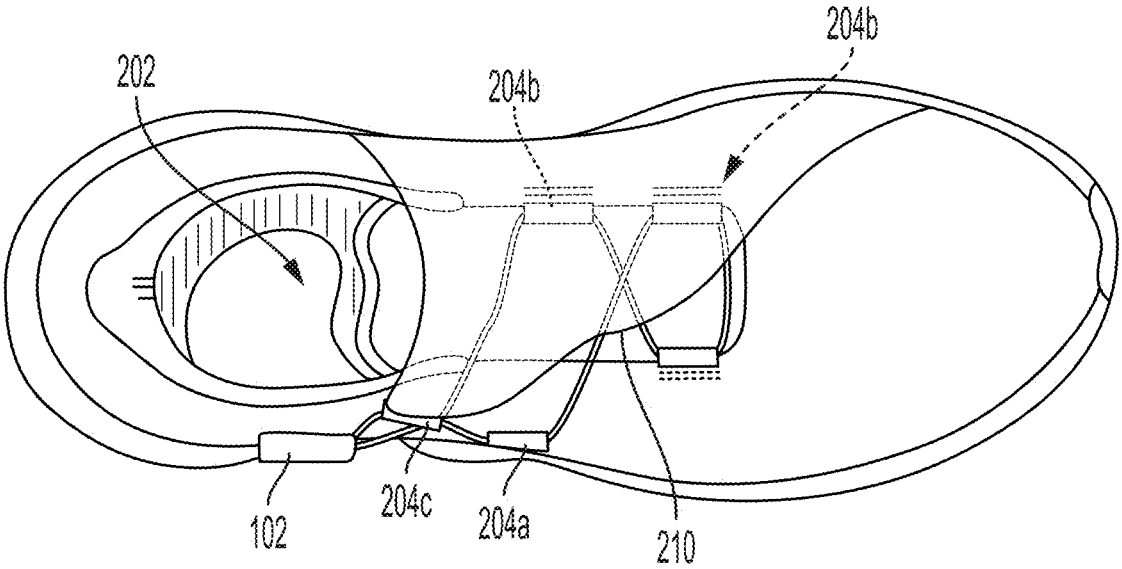

Referring now to FIGS. 4A-B, illustrated is an article of footwear or shoe that includes a tightening mechanism 102 positioned on the side of the shoe. The tightening mechanism is operably coupled with a tension member 106 that is routed or guided along a path about the shoe via a plurality of guides—i.e., guides 204*a*, 204*b*, and 204*c*. The path of the tension member 106 traverses between an opening 202 of the shoe and between the guides (204*a*, 204*b*, and 204*c*) positioned on opposing sides of the opening 202. One or more proximal guides 204*a* are attached to the upper of the shoe, which may be near an eyestay, near a sole, or closer to a midpoint between the eyestay and sole of the shoe. One or more distal guides 204*b* are attached to an opposite side of the shoe and may be near an eyestay, near a sole, or closer to a midpoint between the eyestay and sole. In the illustrated embodiment, two distal guides 204*b* are attached to the eyestay of the shoe.

The shoe includes a panel 210 that is coupled or fixed with a first side of the shoe (e.g., the medial side) and that extends upward toward a second side of the shoe. The panel 210 extends at least partially over the opening 202 of the shoe. The panel 210 is triangular in shape with an upper portion that extends past a lateral centerline of the shoe. The upper portion is positioned near a throat of the shoe. The panel 210, and in particular the upper portion of the panel 210, covers the shoe's opening 202 or throat. The panel 210 may also cover the one or more distal guides 204*b*. The triangular shape of the panel 210 results in the lower portion of the panel 210 not covering the entire opening or throat of the shoe. The panel 210 is typically formed of a continuous panel segment as illustrated in FIGS. 4B, although in some embodiments the panel 210 may be formed of multiple panel segments or straps.

At least one panel guide 204*c*, and in some embodiments a single guide, is attached to the panel 210. In the illustrated embodiment, a single panel guide 204*c* is attached to the distal end of the triangle shaped panel 210. In some embodiments the panel guide(s) 204*c* may be attached to an inner surface of the panel 210 so as to be hidden from view. The tension member 106 is routed through the panel guide(s) 204*c* so that tensioning of the tension member 106 causes the tension member 106 to tension the panel 210, which pulls the panel 210 toward the second side of the shoe and increases the fit of the shoe about the wearer's foot.

As illustrated in FIGS. 4A-B, the tension member 106 is routed from the tightening mechanism 102 and through the panel guide 204*c*. The tension member 106 is routed from the panel guide 204*c* to the proximal guide 204*a* positioned on the second side of the shoe. The tension member 106 is then routed between the proximal guides 204*a* and distal guides 204*b* positioned on opposite sides of the throat or tongue until the tension member 106 is routed back to the tightening mechanism 102. Tensioning the tension member 106 causes the tension member 106 to pull the panel 210 toward the second side 114, via panel guide(s) 204*c*, while simultaneously pulling the opposing sides of the shoe, and in particular the opposing sides of the throat or tongue, towards one another. In this manner, the tension member 106 and a single reel based closure device 102 may be employed to simultaneously tension the panel 210 and opposing sides of the shoe.

The guides (204*a*, 204*b*, & 204*c*) may be formed of rigid, semi-rigid, or flexible materials. In one embodiment, one or more of the guides may be formed of a fabric material that is folded to form a loop or channel through which the tension member 106 is inserted. In other embodiments, one or more of the guides may be formed of more rigid materials, such as plastic materials, metal materials, and the like. The other guides described herein may be formed in like manner.

Figure 5A:
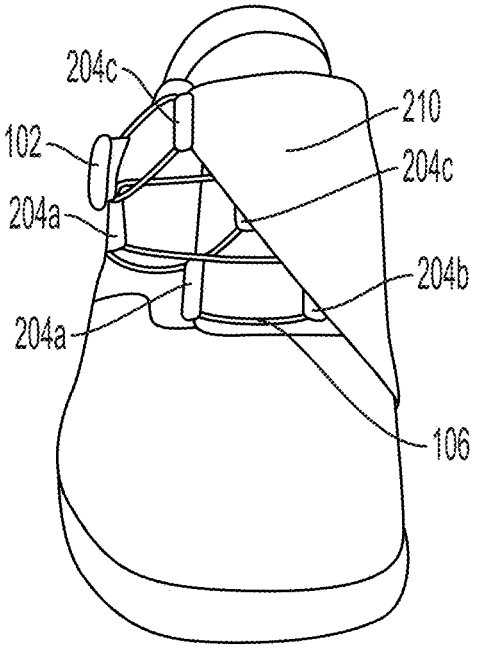
FIGS. 5A-D illustrate various embodiments of article of footwears having a panel system and tightening mechanism.

Referring now to FIG. 5A, illustrated is a shoe that is similar to the shoe of FIGS. 4A-B. Specifically, the shoe includes a tightening mechanism 102 positioned on the side of the shoe, which is operably coupled with a tension member 106 routed or guided along a path about the shoe via a plurality of guides. The shoe also includes one or more proximal guides 204*a* attached to the upper on the second side of the shoe. In the illustrated embodiment, one of the proximal guides 204*a* is positioned on the eyestay while another proximal guide 204*a* is positioned at a midpoint between the eyestay and sole of the shoe.

The shoe also includes a panel 210 that is coupled or fixed with the first side of the shoe (e.g., the medial side) and that extends upward toward the second side of the shoe. The panel 210 extends at least partially over the opening of the shoe. The panel 210 is triangular in shape and has a similar configuration to the panel of FIGS. 4A-B. The panel 210 of FIG. 5A includes at least two panel guides 204*c* with one of the panel guides 204*c* being attached to the distal end of the triangle shaped panel 210 and the other being attached near a longitudinal center of the panel 210. The panel guide 204*c* that is attached near the longitudinal center of the panel 210 may be attached to an inner surface of the panel 210 so as to be hidden from view. The shoe additionally includes one or more distal guides 204*b* that may be attached to the eyestay, or near the eyestay, on the first side of the shoe. In some embodiments, the distal guide(s) 204*b* may be attached to the inner surface of the panel 210 rather than being attached to the upper of the shoe. However, attaching the distal guide(s) 204*b* to the shoe's upper enables the tension member 106 to simultaneously tension the panel 210 and the opposing sides of the shoe. The panel 210 typically covers the distal guide(s) 204*b*.

The panel 210 is typically formed of a continuous panel segment as illustrated in FIGS. 4B, although in some embodiments the panel 210 may be formed of multiple panel segments or straps. The tension member 106 is routed through the each of the guides, 204*a*, 204*b*, & 204*c*, as previously described.

Figure 5B:
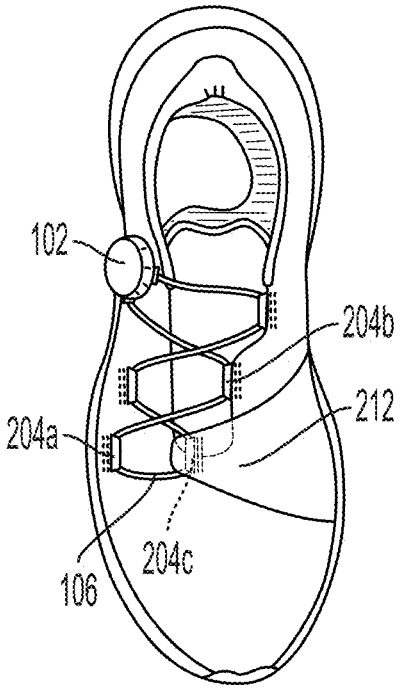

Referring now to FIG. 5B, illustrated is another shoe that is similar to the embodiments described herein. The shoe includes a tightening mechanism 102 positioned on the side of the shoe that is operably coupled with the tension member 106 routed or guided along a path about the shoe via the plurality of guides. The shoe includes one or more proximal guides 204*a* attached to the upper on the second side of the shoe. In the illustrated embodiment, two proximal guides 204*a* are positioned laterally offset from the eyestay at a midpoint between the eyestay and sole of the shoe.

The shoe also includes a panel 212 that is coupled or fixed with the first side of the shoe (e.g., the medial side) and that extends upward toward the second side of the shoe. The panel 212 extends at least partially over the opening of the shoe. The panel 212 is triangular in shape with a lower portion that extends past a lateral centerline of the shoe. The lower portion is positioned near a toe box of the shoe. The panel 212, and in particular the lower portion of the panel 212, covers the opening or throat of the shoe. The panel 212 may cover one or more distal guides 204*b*, although in the illustrated embodiment neither of the distal guides 204*b* are covered. The triangular shape of the panel 212 results in the upper portion of the panel 212 not covering the entire opening or throat of the shoe. In the illustrated embodiment, only the lower portion of the shoe's throat or tongue is covered while the upper and mid-portion of the shoe's throat or tongue are exposed or uncovered. The panel 212 is typically formed of a continuous panel segment, although it may be formed of multiple panel segments or straps.

In the illustrated embodiment, the panel 212 includes a single panel guide 204*c* that is attached to the distal end of the triangle shaped panel 212. The single panel guide 204*c* may be attached to an inner surface of the panel 212 so as to be hidden from view or may be attached to the edge of the panel 212. The shoe additionally includes one or more distal guides 204*b* that may be attached to the eyestay, or near the eyestay, on the first side of the shoe. In the embodiment of FIG. 5B, two distal guides 204*b* are attached to a non-linear eyestay so that an upper distal guide 204*b* is positioned laterally closer to the sole than a middle distal guide 204*b*. The tension member 106 is routed through the each of the guides, 204*a*, 204*b*, & 204*c*, as previously described.

Figure 5C:
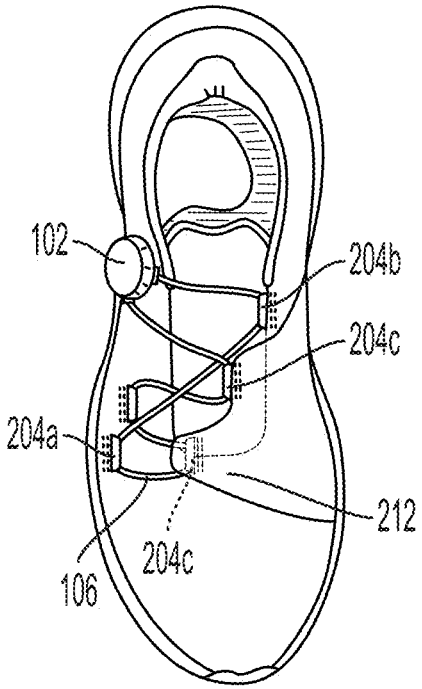

FIG. 5C is very similar in configuration to FIG. 5B except that the panel 212 includes two panel guides 204*c*. A lower panel guide 204*c* is attached to the panel 212 as described in FIG. 5B while a middle panel guide 204*c* is attached to the panel near a longitudinal center of the shoe's throat or tongue. The middle panel guide 204*c* may be attached to the inner surface of the panel 212 so as to be hidden from view or may be attached to the edge of the panel 212 so as to be visible, as illustrated in FIG. 5C. The panel 212 of FIG. 5C is longitudinally longer than the panel of FIG. 5B. The panel 212 includes a relatively straight edge or portion about which the middle panel guide 204*c* is coupled. The panel 212 configuration of FIG. 5C results in more of the shoe's throat or tongue being covered in comparison with the panel of FIG. 5B.

In some embodiments, the shoe includes a single distal guide 204*b*. The positioning of the middle panel guide 204*c* on the panel 212 may result in the two proximal guides 204*a* being positioned closer together on the second side of the shoe. The tension member 106 is routed through the each of the guides, 204*a*, 204*b*, & 204*c*, as previously described.

Figure 5D:
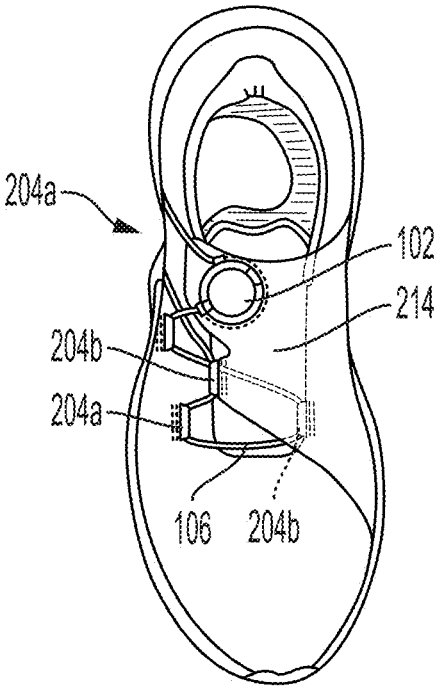

Referring now to FIG. 5D, illustrated is a shoe that is similar to the shoes described herein with a variation on the panel 214 that is attached to the shoe. The panel 214 is similar in construction to the panel of FIG. 5A in that the panel 214 is coupled or fixed with the first side of the shoe and extends upward toward the second side partially over the shoe's lateral centerline. The panel 214 is roughly triangular in shape but is longitudinally longer than the panel of FIG. 5A. The panel 214 includes a relatively straight edge or mid-portion about which the panel guide 204*c* is coupled. The panel guide 204*c* may be attached to the inner surface of the panel 214 so as to be hidden from view or may be visible on the edge of the panel 214. The panel 214 of FIG. 5D results in more of the shoe's throat or tongue being covered in comparison with the panel of FIG. 5A.

The tightening mechanism 102 is positioned on the proximal edge of the panel 214 rather than being attached to the side of the shoe. The tightening mechanism 102 is operably coupled with the tension member 106 that is routed or guided along a path about the shoe via the plurality of guides, 204*a*, 204*b*, & 204*c*. One or more proximal guides 204*a* are attached to the upper on the second side of the shoe. In the illustrated embodiment, the one of the proximal guides 204*a* are positioned laterally offset from the eyestay near a midpoint between the eyestay and sole of the shoe, although the positioning of the proximal guides 204*a* may be varied. The shoe also includes a proximal guide 204*a* (not shown) that is positioned closer to the heel and closer to the sole of the shoe, which functions to pull the proximal end/edge of the panel 214 rearward toward the heel. In some embodiments, the proximal guide 204*a* (not shown) that is positioned closer to the heel and sole may include a pair of guides that function together as a single elongated guide (see e.g., FIG. 6A).

The shoe includes one or more distal guides 204*b* that are attached to the first side of the shoe. The distal guides 204*b* may be covered by the panel 214. In the illustrated embodiment, the shoe includes a single distal guide 204*b* that is positioned on the eyestay of the first side of the shoe, although additional distal guides may be employed. The panel 214 is typically formed of a continuous panel segment, although in some embodiments the panel 214 may be formed of multiple panel segments or straps. The tension member 106 is routed through the each of the guides, 204*a*, 204*b*, & 204*c*, as previously described.

Figure 6A:
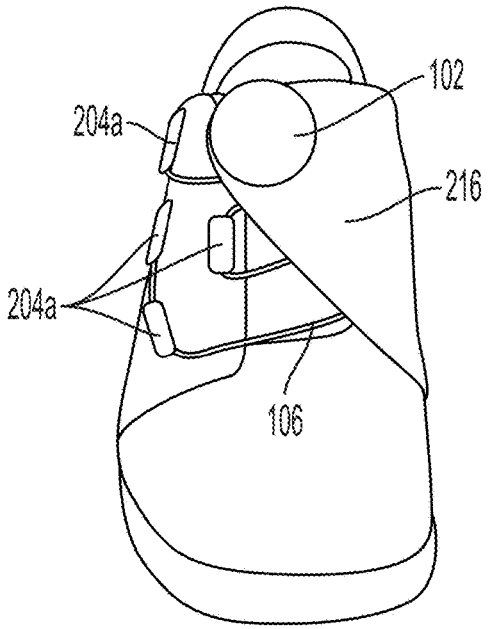
FIGS. 6A-D illustrate various embodiments of article of footwears having a panel system and tightening mechanism.
Figure 6B:
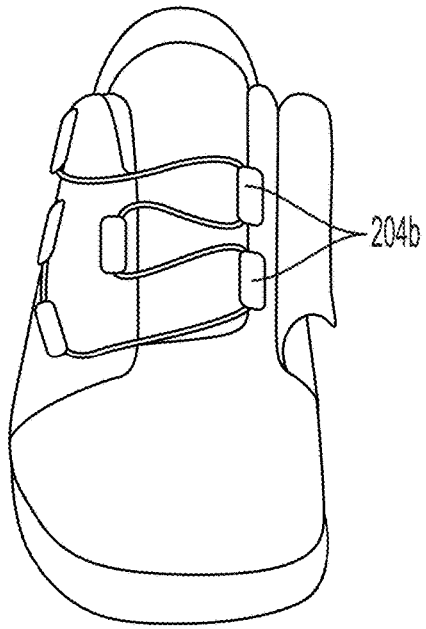

Referring to FIGS. 6A-B, illustrated is a shoe that includes a panel 216 having a similar construction to the panel of FIG. 5D. Specifically, the panel 216 is coupled or fixed with the first side of the shoe and extends toward the second side of the shoe, partially over the lateral centerline of the shoe. The tightening mechanism 102 is positioned on the proximal edge of the panel 216 rather than on the side of the shoe. The panel 216 has a triangular shape that corresponds closely with the panel of FIG. 5A. Specifically, unlike the panel of FIG. 5D, the panel 216 of FIGS. 6A-B does not include a relatively straight edge or mid-portion about which a guide is coupled. Rather, in contrast to the panels of FIGS. 5A-D, the panel 216 of FIGS. 6A-B does not include a panel guide that is attached to the panel 216. Rather, the tightening mechanism 102 attached to the panel 216 functions as the only attachment or coupling point of the tension member 106 to the panel 216.

The shoe includes a plurality of proximal guides 204*a* that are attached to the upper on the second side of the shoe. In the illustrated embodiment, the shoe includes four proximal guides 204*a* attached to the second side of the shoe. These four proximal guides 204*a* include a rear most guide that is positioned closer to the shoe's heel and sole, a guide that is positioned on the second side's eyestay, and two guides that are positioned laterally offset from the eyestay. The two laterally offset guides function together as a single elongated guide.

The shoe also includes a plurality of distal guides 204*b* that are positioned under the panel 216. The distal guides 204*b* may be positioned on the first side's eyestay or laterally offset therefrom. The proximal guide 204*a* that is positioned on the second side's eyestay is positioned longitudinally between the distal guides 204*b*. The panel 216 is typically formed of a continuous panel segment, although in some embodiments the panel 216 may be formed of multiple panel segments or straps. The tension member 106 is routed through the each of the guides, 204*a* & 204*b*, so that tensioning of the tension member 106 simultaneously tensions the panel 216 and the opposing sides of the shoe.

Figure 6C:
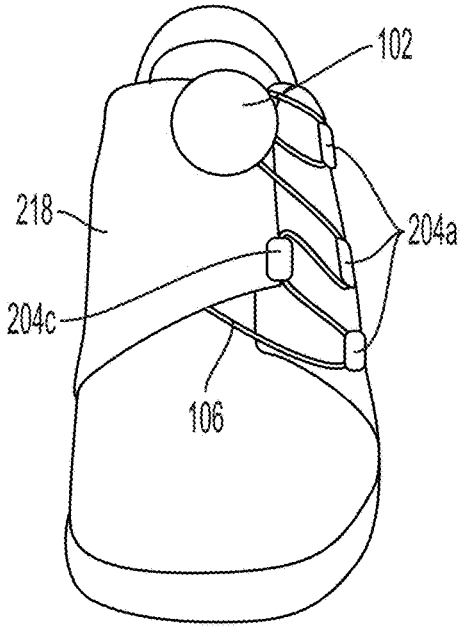
Figure 6D:
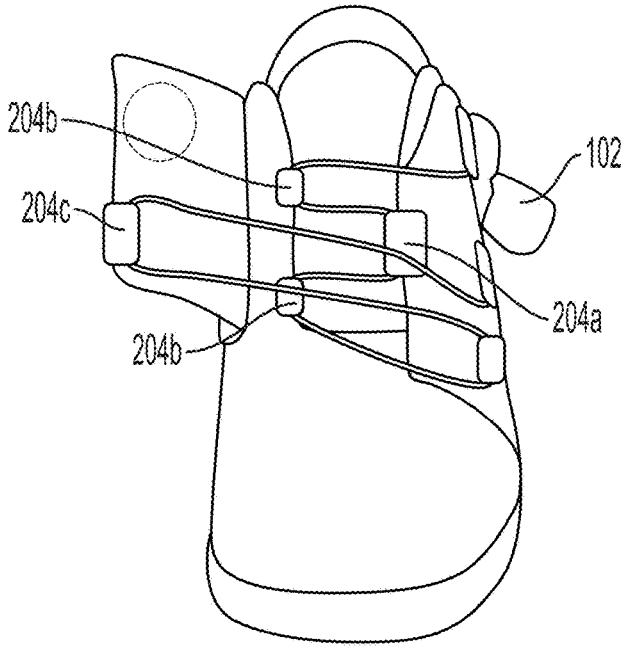

Referring to FIGS. 6C-D, illustrated is a shoe that includes a panel 218 that is coupled or fixed with the first side of the shoe and that extends toward the second side of the shoe over the shoe's lateral centerline. The tightening mechanism 102 is positioned near the proximal edge of the panel 218 toward an upper end positioned adjacent to the shoe's collar. The panel 218 has a more rectangular shape in comparison with the panel of FIGS. 6A-B. The proximal edge of the panel 218 is longitudinally longer than the proximal edge of the panel of FIGS. 6A-B. The longer proximal edge is constructed so that a panel guide 204*c* may be positioned on or near a lower portion of the panel 218 closer to the toe box. The panel guide 204*c* may be attached to the inner surface of the panel 218 so as to be hidden from view or positioned on the proximal edge as illustrated in FIG. 6C. The longer proximal edge of the panel 218 results in the panel covering a greater portion of the shoe's throat or tongue. In some embodiments, the panel 218 may include a relatively straight edge or mid-portion about which a guide is coupled, similar to the panel construction of FIG. 5D.

Similar to the panel of FIGS. 6A-B, the shoe includes a plurality of proximal guides 204*a* (e.g., four proximal guides 204*a*) that are attached to the upper on the shoe's second side. These proximal guides 204*a* may include a rear most guide that is positioned closer to the shoe' heel and sole, a guide that is positioned on the eyestay of the second side (see FIG. 6D), and two guides that are positioned laterally offset from the shoe's eyestay. Unlike the embodiment of FIGS. 6A-B, the two laterally offset guides do not function as a single elongated guide. Rather, the two laterally offset guides are positioned on opposing longitudinal ends of the panel guide 204*c* and route or direct the lace therefrom.

The shoe also includes a plurality of distal guides 204*b* that are positioned under the panel 218. The distal guides 204*b* may be positioned on the eyestay of the shoe's first side or laterally offset therefrom. The proximal guide 204*a* that is positioned on the second side's eyestay is positioned longitudinally between the distal guides 204*b*. The panel 218 is typically formed of a continuous panel segment, although in some embodiments the panel 218 may be formed of multiple panel segments or straps. The tension member 106 is routed through the each of the guides, 204*a*, 204*b*, & 204*c*, so that tensioning of the tension member 106 simultaneously tensions the panel 218 and the opposing sides of the shoe.

Figure 7A:
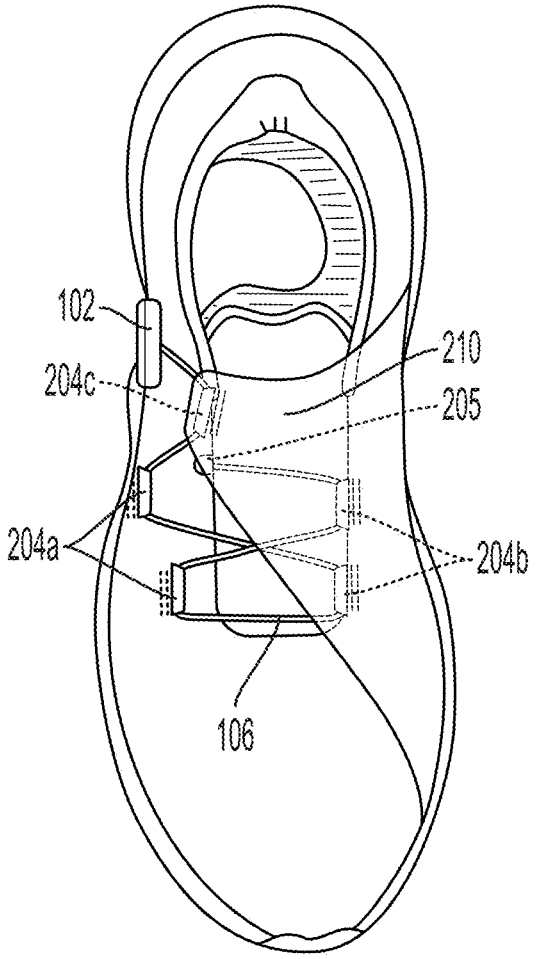
FIGS. 7A-C illustrate various embodiments of article of footwears having a panel system and tightening mechanism.

Referring to FIG. 7A, the illustrated shoe is substantially similar to the shoe of FIGS. 4A-B and the description of that embodiment is equally applicable to the embodiment of FIG. 7A. In particular, the configuration of the panel 210 and the positioning and function of the tightening mechanism 102, tension member 106, and guides, 204*a*, 204*b*, & 204*c*, is substantially the same as the embodiment of FIGS. 4A-B. Thus, for brevity in describing the embodiment of FIG. 7A, the description of these components has been omitted.

FIG. 7A differs from the embodiment of FIGS. 4A-B in that the shoe includes a termination guide 205 that is attached to the shoe's second side. The termination guide 205 functions as a termination or ending point of the tension member 106. In contrast, both ends of the tension member 106 in the embodiment of FIGS. 4A-B are attached to the tightening mechanism 102 and/or operably coupled therewith. The use of the termination guide 205 allows a single end of the tension member 106 to be tensioned upon operation of the tightening mechanism, which may result in an increased tension being induced in the tension member 106. In addition to the use of the termination guide 205, the panel guide 204*c* may be positioned atop the panel 210 and a lower most proximal guide 204*a* may be laterally offset from the eyestay of the shoe's second side.

The panel 210 of FIG. 7A is typically formed of a continuous panel segment, although in some embodiments the panel 210 may be formed of multiple panel segments or straps. The tension member 106 is routed through the each of the guides, 204*a*, 204*b*, & 204*c*, so that tensioning of the tension member 106 simultaneously tensions the panel 210 and the opposing sides of the shoe.

Figure 7B:
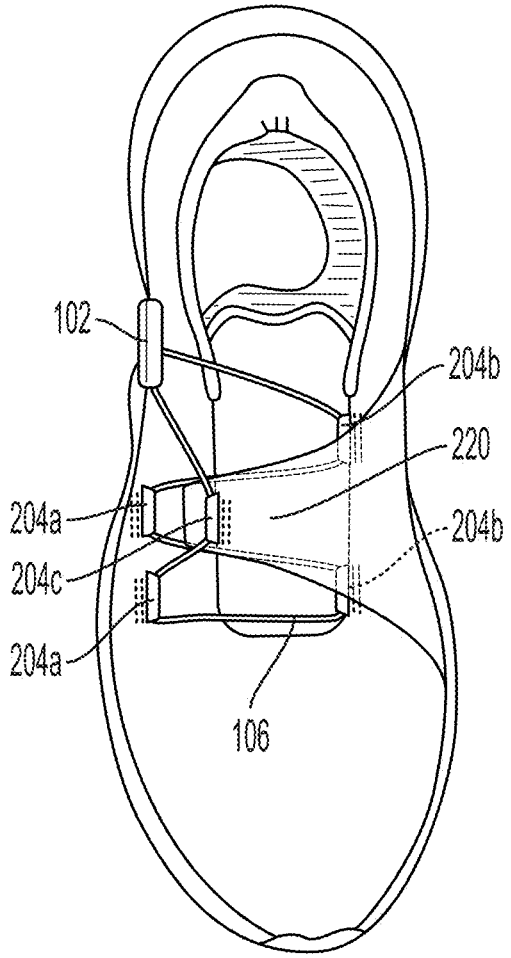

Referring to FIG. 7B, illustrated is a shoe that includes a panel 220 that is positioned near or at a longitudinal center of the shoe's tongue or throat. As with other embodiments, the panel 220 is coupled or fixed with the first side of the shoe and extends toward the second side of the shoe. The tightening mechanism 102 is positioned on the second side of the shoe and is operably coupled with the tension member 106 that is routed or guided along a path via the plurality of guides, 204*a*, 204*b*, and 204*c*. The panel 220 has a more parabolic shape in comparison with the panels previously described. The panel 220 includes a central region that extends toward the second side of the shoe and laterally over the shoe's lateral centerline. The panel guide 204*c* is attached to the central region of the panel 220 on or near an end thereof. The panel guide 204*c* may be attached to the inner surface of the panel 220, to the outer surface of the panel 220, or along the edge as desired. In the illustrated embodiment, the panel guide 204*c* is attached to the outer surface of the panel 220 so that it is visible.

The opposing sides of the panel 220 flare or extends outward from the central region in a curved or arcuate manner. The panel 220 is positioned about the shoe so that the central region is positioned roughly centrally along the longitudinal length of the shoe's tongue, although the central region may be positioned elsewhere as desired. The tension member 106 is routed from the tightening mechanism 102 to the panel guide 204*c* and is routed therefrom to a lower most proximal guide 204*a* positioned on the shoe's second side. The lower most proximal guide 204*a* may be positioned laterally offset from the eyestay or on the eyestay as desired. A second proximal guide 204*a* may be roughly longitudinally aligned with the panel guide 204*c* and may be positioned laterally outward therefrom as illustrated.

The shoe includes a plurality of distal guides 204*b* that are positioned on the first side of the shoe. The distal guides 204*b* may be positioned on the eyestay of the first side or laterally offset therefrom. The distal guides 204*b* may also be positioned on opposing sides of the panel guide 204*c*. The panel 220 may partially or fully cover and/or conceal the distal guides 204*b*. The panel 220 is typically formed of a continuous panel segment, although in some embodiments the panel 220 may be formed of multiple panel segments or straps. The tension member 106 is routed through the each of the guides, 204*a*, 204*b*, & 204*c*, so that tensioning of the tension member 106 simultaneously tensions the panel 220 and the opposing sides of the shoe.

Figure 7C:
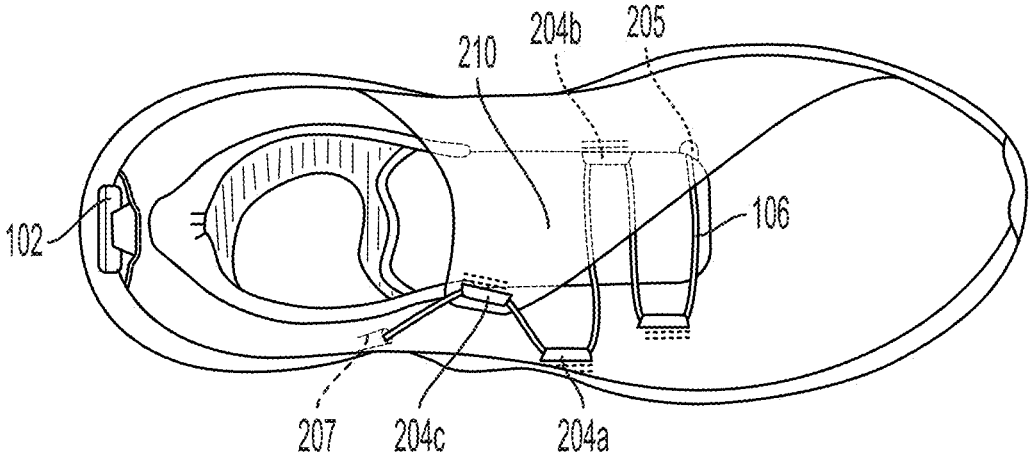

Referring to FIG. 7C, the illustrated shoe is substantially similar to the shoe of FIG. 7A and the description of that embodiment, and the embodiment of FIGS. 4A-B, is equally applicable to the embodiment of FIG. 7C. FIG. 7C differs from the embodiment of FIG. 7A in the positioning of the termination guide 205 and the tightening mechanism 102. Specifically, the termination guide 205 is positioned at a distal end of the tension member path near the shoe's toe box so that the tension member 106 terminates at or near the toe box. The tightening mechanism 102 is positioned on the heel of the shoe and is routed to the front of the shoe via tubing 207 or other routing means, such as channels formed in the upper or guides that are attached to the upper. Although illustrated in FIG. 7C, the positioning of the tightening mechanism 102 on the shoe's heel may be used in any of the other embodiments described herein. Similarly, the use of the termination guide 205 in FIG. 7C may be omitted so that both ends of the tension member 106 attach to tightening mechanism 102 and/or are operable coupled therewith. As described herein, the shoe includes guides, 204*a*, 204*b*, & 204*c* that route or direct the tension member along a path of the shoe. The tension member 106 is routed through the each of the guides, 204*a*, 204*b*, & 204*c*, so that tensioning of the tension member 106 simultaneously tensions the panel 210 and the opposing sides of the shoe.

FIGS. 8A-9C illustrate various embodiments of shoe configurations that may be employed to achieve a desired closure and/or fit of the shoe about a wearer's foot. The embodiments of FIGS. 8A-9C may employ panels, straps, and/or unique lace path configurations that achieve targeted tensioning of the shoe about the wearer's foot. Each of the embodiments employ a tightening mechanism 102 and tension member 106 that is operably coupled with the tightening mechanism 102 as previously described. The tension member 106 is routed through guides that are attached to the shoe, panel, and/or strap so that an operation of the tightening mechanism 102 simultaneously tensions the strap and/or panel and the shoe. The tightening mechanism 102 is generally illustrated as being positioned on or near a tongue of the shoe, although the position of the tightening mechanism 102 may be varied, such as on the heel, the side of the shoe, and the like. The illustrated panel and/or strap configurations, and the tension member paths, may be altered, or combined, to achieve a desired appearance and/or fit of the shoe about the wearer's foot. For brevity in describing the various embodiments, similar reference numerals to previous embodiments have been used in describing the embodiments of FIGS. 8A-9C. It should be realized that the previous description of those components is equally applicable to the embodiments of FIGS. 8A-9C. In addition, a description of specific features or characteristics of similar components may be omitted for purposes of brevity. In such instances, the full description of such features or characteristics is equally applicable to those similar components.

Figure 8A:
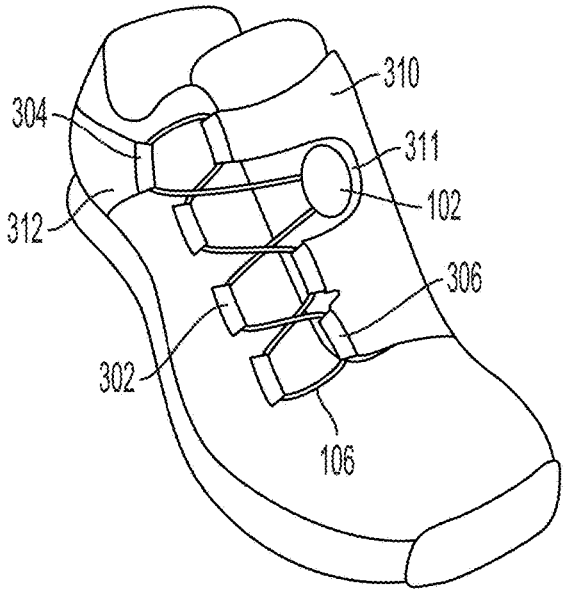
FIGS. 8A-9C illustrate various embodiments of shoe configurations that may be employed to achieve a desired closure and/or fit of the shoe about a wearer's foot.

Referring to FIG. 8A, the illustrated shoe includes a panel 310 that is coupled or fixed with a first side of the shoe and that extends toward the second side of the shoe, partially over a lateral center of the shoe. The panel 310 has a recess, cavity, or opening 311 that is shaped and sized so that the tightening mechanism 102 may be positioned within the opening 311. The panel 310 includes an upper portion and an elongate lower portion. The upper portion and elongate lower portion of the panel 310 extend laterally outward from the opening 311 toward the second side of the shoe. In some embodiments, the upper portion of the panel 310 may extend laterally farther than the elongate lower portion so that the upper portion of the panel 310 wraps more fully around the shoe and wearer's foot. The opening 311 is sized so that when the panel 310 is fully tensioned, the panel 310 does not contact, or minimally contacts, the tightening mechanism 102.

A plurality of panel guides 306 are attached to a proximal edge of the panel 310, although in some embodiments the panel guides 306 may be attached to the inner or outer surface of the panel 310. In the illustrated embodiment, a single panel guide 306 is positioned above the tightening mechanism 102 while two panel guides 306 are positioned below the tightening mechanism 102. One or more proximal guides 302 are attached to the second side of the shoe and are commonly laterally offset from the eyestay near a midpoint between the eyestay and sole. The proximal guides 302 are arranged to route or direct the tension member 106 along a path between the panel guides 306 and proximal guides 302. In some embodiments, the shoe also includes a heel strap 312 that is positioned near the heel and/or that wraps around the shoe's heel. The heel strap 312 includes at least one heel strap guide 304 that routes the tension member along the path. The heel strap 312 may be employed to pull the upper portion of the panel 310 rearward toward the heel to secure the wearer's foot more fully inside the shoe. The panel 310 is typically formed of a continuous panel segment, although in some embodiments the panel 310 may be formed of multiple panel segments or straps.

Figure 8B:
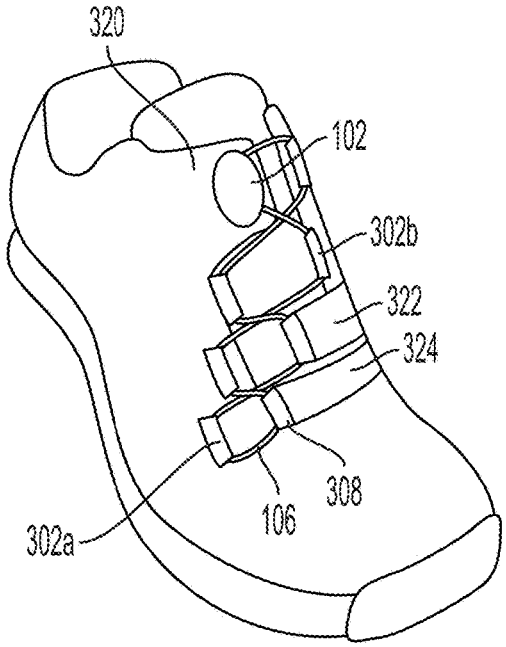

Referring to FIG. 8B, the illustrated shoe includes a panel or strap 320 that is coupled or fixed with the second side of the shoe and that extends toward the first side of the shoe, partially over the shoe's lateral center. The panel 320 is formed from, or coupled with, an upper portion of the eyestay of the shoe's second side. The portion of the eyestay that is longitudinally below the panel 320 may be roughly linear in shape. The tightening mechanism 102 is coupled with the panel 320 so that that when the panel is tensioned, the tightening mechanism 102 is laterally positioned roughly centrally about the shoe's tongue.

A plurality of proximal guides 302*a* are attached to the second side of the shoe longitudinally below the panel 320. The proximal guides 302*a* may be attached to the eyestay on the second side of the shoe or may be positioned laterally offset therefrom. One or more distal guides 302*b* are positioned on the first side of the shoe. The distal guides 302*b* may be attached to the eyestay on the first side of the shoe or may be positioned laterally offset therefrom. The distal guides 302*b* are typically positioned longitudinally near the panel 320 with at least one guide being longitudinally aligned with the tightening mechanism 102 and spaced laterally offset therefrom.

The shoe also includes at least one lower strap 322 that is coupled with the first side of the shoe and that extends over the shoe's lateral center toward the second side. In the illustrated embodiment, the shoe includes two lower strap, 322 & 324, in which a lowest positioned strap 324 extends farther across the shoe than the other strap 322. Both straps include a strap guide 308 that is configured to route or direct the tension member 106 and that is positioned to function with a corresponding proximal guide 302*a* on the second side of the shoe. The use of the panel 320 and the one or more lower straps, 322 & 324, causes the upper and lower portions of the shoe to wrap about the wearer's foot in opposing directions, which may increase the fit of the shoe about the wearer's foot.

Figure 8C:
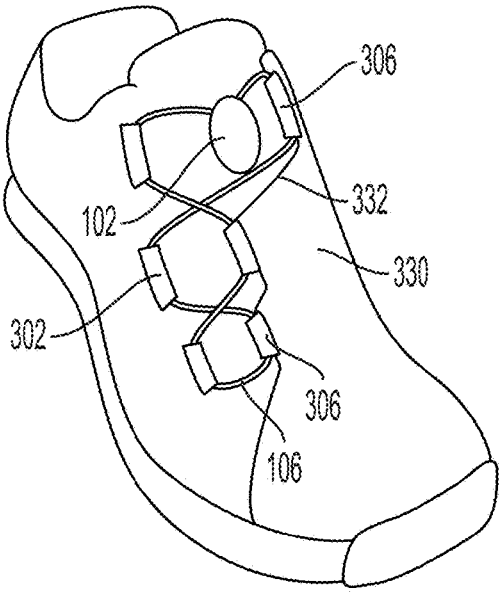

Referring to FIG. 8C, the illustrated shoe includes a panel 330 that is coupled or fixed with the first side of the shoe and that extends toward the second side of the shoe, partially over the shoe's lateral center. The panel 330 is formed from, or coupled with, a lower portion of the eyestay of the shoe's first side. The panel 330 is shaped so that a recess, cavity, or opening 332 is formed or defined in the upper portion of the panel 330 adjacent to the shoe's collar. The opening 332 is shaped and sized so that the tightening mechanism 102 is positionable within the opening 332. The lower portion of the panel 330 extends laterally outward from the opening 332 toward the second side of the shoe. In some embodiments, a lower most portion of the panel 330 may extend laterally farther than a mid-portion of the panel 330. The panel 330 may have a non-linear profile along its longitudinal length from the shoe's collar to the toe box.

A plurality of proximal guides 302 are attached to the second side of the shoe and a plurality of panel guides 306 are attached to the panel, either along the panel's edge or on an inner or outer surface thereof. In the illustrated embodiment, an equal number of proximal guides 302 and panel guides 306 are employed and each of the proximal guides 302 is longitudinally aligned with a corresponding panel guide 306. Each proximal guide 302 and panel guide 306 may form a guide pair that routes or directs the tension member 106. A spacing between each guide pair may decrease as the lace path nears the toe box.

Figure 8D:
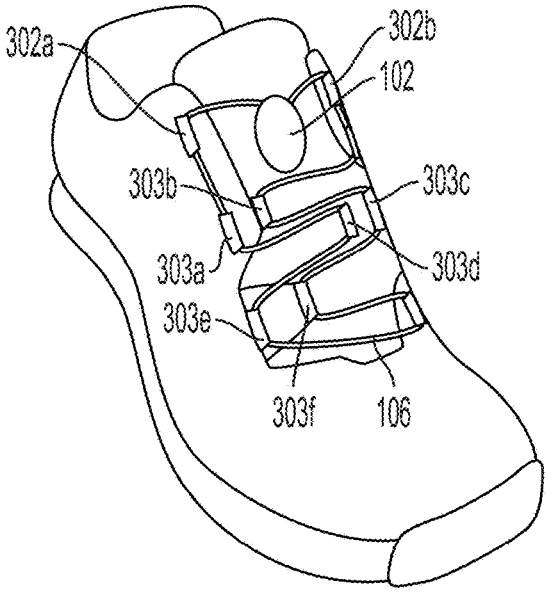

Referring to FIG. 8D, the illustrated shoe does not include a panel, but rather includes or defines a unique tension member path and pairing of tension member guides. The shoe includes a tightening mechanism 102, which may be centrally located on the shoe's tongue or elsewhere as desired, such as on the heel or side of the shoe. The shoe also includes one or more proximal guides 302*a* and distal guides 302*b* that route or direct the tension member in a normal manner. The shoe further includes one or more guide pairs, in which one guide of the pair is positioned laterally offset from the other guide of the pair.

In the illustrated embodiment, the shoe includes three guide pairs. Specifically, an upper guide pair includes an outer guide 303*a* and an inner guide 303*b* that is positioned laterally inside of the outer guide 303*a*. The inner guide 303*b* may be positioned on the shoe's eyestay while the outer guide 303*a* is laterally offset therefrom. In other embodiments, the inner guide 303*b* may be positioned on a strap (see guide 303*f*) while the outer guide 303*a* is positioned on the eyestay or laterally offset therefrom. The upper guide pair function together to increase a tensioning force that is imparted to close and tighten an upper portion of the shoe adjacent to the upper guide pair.

The shoe also includes a mid-guide pair that includes an outer guide 303*c* and an inner guide 303*d* that is positioned laterally inside of the outer guide 303*c*. The inner guide 303*d* may be positioned on the shoe's eyestay, or on the end of a strap, while the outer guide 303*c* is positioned on the eyestay or laterally offset therefrom. The mid-guide pair function together to increase a tensioning force that is imparted to close and tighten a mid-portion of the shoe adjacent to the mid-guide pair. The shoe further includes a lower guide pair that includes an outer guide 303*e* and an inner guide 303*f* that is positioned laterally inside of the outer guide 303*e*. The inner guide 303*f* is illustrated as being positioned on the end of a small strap, although the inner guide 303*f* may be positioned on the eyestay if desired. The outer guide 303*e* may be positioned on the shoe's eyestay or laterally offset therefrom. The lower guide pair function together to increase a tensioning force that is imparted to close and tighten a lower portion of the shoe adjacent to the lower guide pair and near the toe box.

Although FIG. 8D illustrates three guide pairs being used, it should be realized that more or fewer guide pairs may be employed. Similarly, the position of the guide pair, or guide pairs, may be varied to achieve an increased tensioning force in a desired location. For example, a guide pair may be used longitudinally above the tightening mechanism 102 to impart an increased tensioning force near the shoe's collar.

Figure 9A:
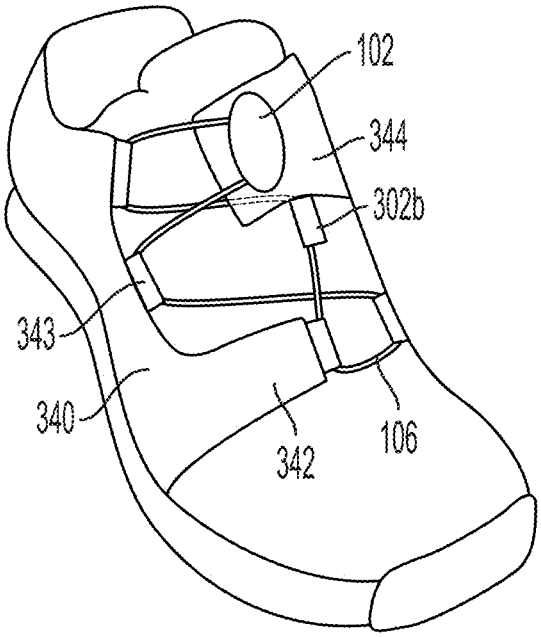

Referring to FIG. 9A, the illustrated shoe includes a panel 340 that is coupled or fixed with the second side of the shoe and that extends toward the first side of the shoe. A majority of the panel 340 is laterally offset from the shoe's lateral center or tongue. A lower portion or end 342 of the panel 340, however, extends to near the shoe's lateral center or extends distally thereof. The lower portion 342 of the panel 340 may be a strap that is coupled with the panel 340 or formed therefrom. In some embodiments, the panel 340 may have a generally u-shaped configuration between its upper end and lower portion 342. The panel 340 and lower portion 342 include one or more panel guides 343 that are attached to an edge of the panel 340/lower portion 342 or that are attached to an inner or outer surface thereof.

The shoe also includes a strap 344 that is attached to the shoe's first side and that extends toward the second side. The strap 344 may be positioned near the shoe's collar so that the strap 344 extends toward the laterally offset portion of the panel 340. The tightening mechanism 102 is attached to the strap 344 and is positioned so that when the strap 344 is tensioned, the tightening mechanism 102 is laterally positioned roughly centrally about the shoe. The shoe further includes one or more distal guides 302*b* that are attached to the first side of the shoe. One of the distal guides 302*b* may be partially or fully positioned under the strap 344 when the strap 344 is tensioned. Another distal guide 302*b* may be laterally offset from the distal guide 302*b* that is positioned under the strap 344. In some embodiments, the distal guide 302*b* that is positioned under the strap 344 may route or direct the lace to the panel guide 343 that is attached to the end of the lower portion 342 of the panel 340. The tension member segment that spans these two guides may be roughly aligned with, or parallel with, a lateral centerline of the shoe.

Figure 9B:
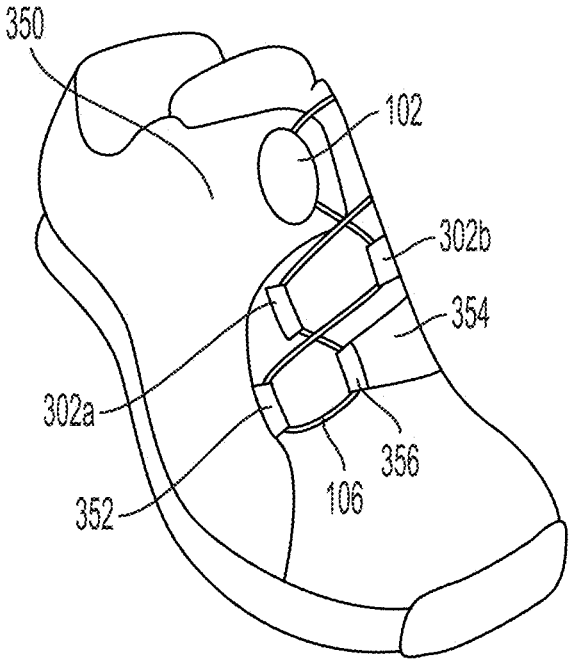

Referring to FIG. 9B, the illustrated shoe includes a panel 350 that is coupled or fixed with the second side of the shoe and that extends toward the first side of the shoe. An upper end of the panel 350 extends to near the shoe's lateral center or extends distally thereof while a lower portion of the panel 350, and often a majority of the panel 350, is laterally offset from the shoe's lateral center or tongue. The tightening mechanism 102 is attached to the upper end of the panel 350 and is positioned so that when the panel 350 is tensioned, the tightening mechanism 102 is laterally positioned roughly centrally about the shoe. The upper end of the panel 350 may be a strap that is coupled with the panel 350 or formed therefrom. In some embodiments, the panel 350 may have a generally curved or arcuate shape between its upper end and lower end. The panel 350 include one or more panel guides 352 that are attached to an edge of the panel 350 or that are attached to an inner or outer surface thereof. In the illustrated embodiment, the panel 350 includes a single guide 352 that functions in combination with the tightening mechanism 102 to pull the panel 350 over the upper of the shoe. In other embodiments, additional panel guides 352 may be employed.

The shoe also includes a strap 354 that is attached to the shoe's first side and that extends toward the second side. The strap 354 may be positioned near the shoe's toe box so that the strap 354 extends toward the laterally offset portion of the panel 350. The strap 354 includes a strap guide 356 that is attached to an edge of the strap 354 or attached to an inner or outer surface thereof. The shoe further includes one or more proximal guides 302*a* and distal guides 302*b* that are attached to the respective sides of the shoe. One or more pairs of the proximal and distal guides, 302*a* & 302*b*, may function cooperatively to route or direct a mid-section of the tension member 106. The one or more proximal and distal guides pairs, 302*a* & 302*b*, may be positioned longitudinally between the upper end of the panel 350 and the strap 354.

Figure 9C:
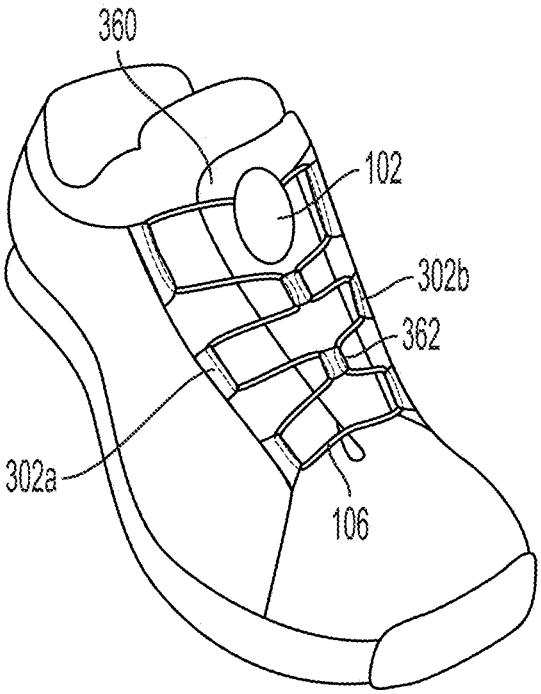

Referring to FIG. 9C, the illustrated shoe includes a panel 360 that is coupled or fixed with the first side of the shoe and that extends toward the second side of the shoe. The panel 360 includes a linear edge that parallels a lateral centerline of the shoe, although other configurations of the panel's edge are possible. The panel 360 may extend to near the shoe's lateral centerline or extend distally thereof. The tightening mechanism 102 is attached to the upper end of the panel 360 near the shoe's collar. In some embodiments, the tightening mechanism 102 may be positioned on the heel, on the side of the shoe, or elsewhere. The panel 360 include one or more panel guides 362 that are attached to on outer surface of the panel 360 so that when the panel 360 is tensioned, the panel guides 362 are roughly aligned with the shoe's lateral center.

The shoe includes proximal guides 302*a* that are attached to the second side of the shoe and distal guides 302*b* that are attached to the first side of the shoe. The proximal and distal guides, 302*a* & 302*b*, function to route or direct the tension member to and from the panel guides 362. The use of the panel guides 362 in the lateral center of the shoe may facilitate in providing an even closure of the shoe about the wearer's foot.

Referring to FIGS. 10A-11C, illustrated are embodiments of footwear configurations that achieve a snug fit of the footwear about a wearer's foot using a single reel based closure device 102. The footwear configurations of FIGS. 10A-11C may be particularly suited for use with high cut articles of footwear, such as various boots. The footwear configurations provide a good fit on the high cut footwear about the wearer's foot. In some instances, the high cut footwear may have a hybrid constructions in which the upper portion of the footwear has a standard tongue construction and the lower portion of the footwear has a canopy type construction. The single reel based closure device 102 provides a uniform fit of the footwear about the wearer's foot from the upper portion to the lower portion of the closure zone.

Figure 10A:
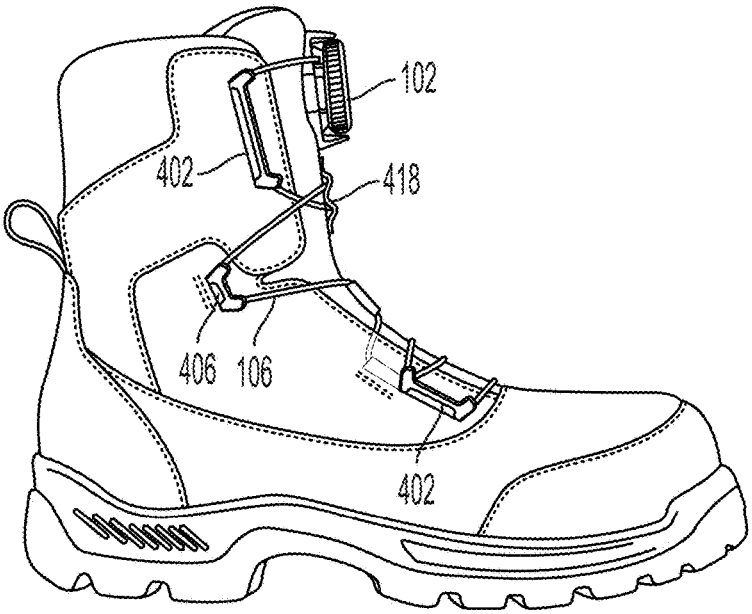
FIGS. 10A-11C illustrate embodiments of footwear configurations that achieve a snug fit of the footwear about a wearer's foot using a single reel based closure device.
Figure 10B:
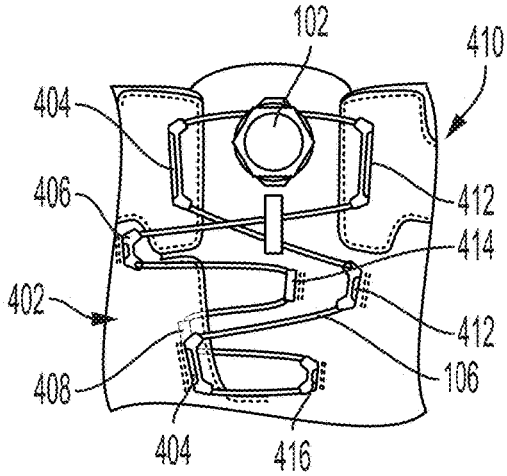
Figure 10C:
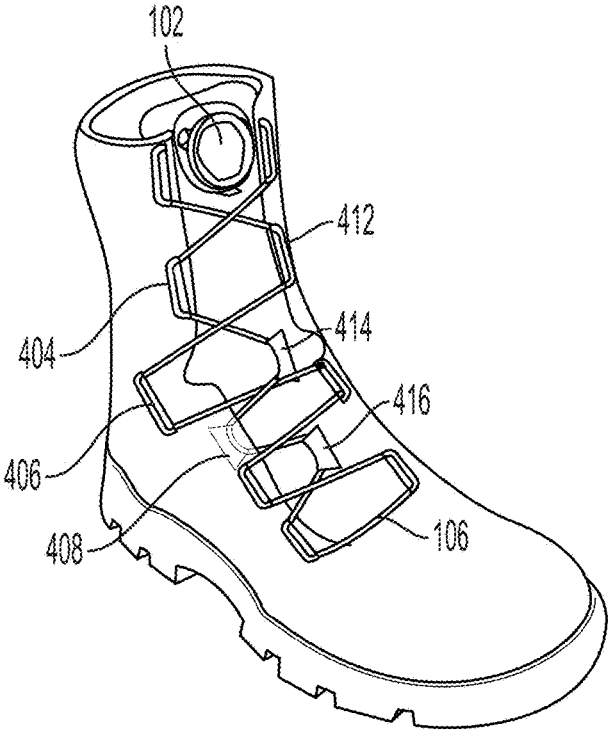

Referring to FIGS. 10A-C, illustrated is an embodiment in which the footwear or boot (hereinafter boot) has an overlapping guide configuration on the lower portion of the boot. The overlapping guide configuration is achieved via asymmetrically located guides that work together in a pulley like manner to create a snug fit of the boot about the wearer's foot. The overlapping configuration enables the lower portion of the boot to adapt to the volume and/or shape of the wearer's foot.

The boot includes a proximal side 402 and a distal side 410, which are positioned on opposing sides of the boot and are commonly separated by an opening or tongue portion of the boot. A first proximal set of guides 404 is positioned on the proximal side 402 of the boot while a first distal set of guides 412 is positioned on the distal side 410 of the boot. The first proximal set of guides 404 is positioned along a proximal eyestay of the boot in a typically manner. More specifically, the first proximal set of guides 404 are positioned so that an edge of each guide is positioned near the edge of the proximal eyestay. Similarly, the first distal set of guides 412 is positioned along a distal eyestay in a typically manner, in which an edge of each guide is positioned near the edge of the distal eyestay.

A second proximal set of guides, 406 & 408, is also positioned on the proximal side 402 of the boot. The second proximal set of guides, 406 & 408, are positioned asymmetrically in relation to the first proximal set of guides 404. Specifically, as illustrated in FIG. 10B, an upper guide 406 of the second proximal set of guides is positioned laterally outward from the proximal eyestay so as to be positioned closer to the heel and/or sole of the boot in comparison with the first proximal set of guides 404. The laterally outward positioning of the upper guide 406 results in an increased rearward and downward tension being imparted on the boot via the tension member 106. The position of the upper guide 406 may be selected so that the increased rearward and downward tension or pressure results in a desired tightening of the boot about the wearer's foot, such as near the wearer's heel.

A lower guide 408 of the second proximal set of guides is positioned under the proximal eyestay near a lower guide of the first proximal set of guides 404. The lower guide 408 may be laterally offset from the proximal eyestay, similar to the upper guide 406, or may be roughly aligned with the lower guide of the first proximal guide set 404 as illustrated in FIG. 10B. In either embodiment, the lower guide 408 is typically longitudinally offset from the lower guide of the first proximal guide set 404 by either being positioned closer to the toe box or the collar of the boot.

The lower guide 408 functions with the lower guide of the first proximal set of guides so that the two guides work together in a pulley like manner to create a snug fit of the boot about the lower portion of the wearer's foot. It should be noted that although the lower guide 408 and the lower guide of the first proximal guide set 404 are illustrated as being positioned near a bottom end of the lace path, in some embodiments, the two guides may be positioned closer to a top end of the lace path to create a snug fit of the boot about the upper portion of the wearer's foot.

A second distal set of guides, 414 & 416, may also be positioned on the distal side 410 of the boot. When employed, the second distal set of guides, 414 & 416, are positioned asymmetrically in relation to the first distal set of guides 412. Specifically, as illustrated in FIG. 10B, an upper guide 414 of the second distal set of guides is positioned laterally inward from the distal eyestay so as to be positioned closer to a lateral center of the boot in comparison with the first distal set of guides 412. The laterally inward positioning of the upper guide 414 results in a lateral tension being imparted on the boot near the lateral center of the boot. In the illustrated embodiment of FIG. 10B, the upper guide 414 is roughly aligned longitudinally with a lower guide of the first distal guide set 412. In this manner, the upper guide 414 functions with the lower guide of the first distal set of guides so that the two guides work together in a pulley like manner to create a snug fit of the boot about a mid-portion of the wearer's foot.

A lower guide 416 of the second distal set of guides may also be positioned laterally inward from the distal eyestay so as to be positioned closer to the lateral center of the boot in comparison with the first distal set of guides 412. The laterally inward positioning of the lower guide 416 results in a lateral tension being imparted on the boot near the lateral center of the boot. It should be noted that in some embodiments, the lower guide 416 may be longitudinally aligned with a guide of the first distal set of guides (not shown) so that the lower guide 416 work with that guide in a puller like manner to impart a desired tension force on the wearer's foot. It should also be noted that the upper guide 414 and/or lower guide 416 may be positioned laterally outward from the first distal set of guides if desired.

FIG. 10C illustrates a slight variation on the guide path of FIGS. 10A and B. Specifically, the boot includes additional guides in both the first proximal set of guides 404 and the first distal set of guides 412. The boot also includes a pair of guides of the first proximal set of guides 404 and the first distal set of guides 412 that are positioned at the bottom end of the lace path. Furthermore, neither the lower guide 408 nor the upper guide 414 are longitudinally aligned with a respective guide of the first proximal set of guides 404 or the first distal set of guides 412. Rather, the lower guide 408 and upper guide 414 are positioned longitudinally between guides of the first proximal set of guides 404 and the first distal set of guides 412, respectively. Despite not being longitudinally aligned, the lower guide 408 and/or upper guide 414 may still function in a pulley like manner with the other guides.

In some embodiments, the reel based closure device 102 may be positioned centrally on the boot's tongue as illustrated, although the reel based closure device 102 may be positioned elsewhere as desired, such as on the eyestay, the heel, or the rear portion of the boot. A lace tender 418 may also be used to help guide the tension member 106 and/or maintain a position of the tension member about the boot's tongue.

Figure 11A:
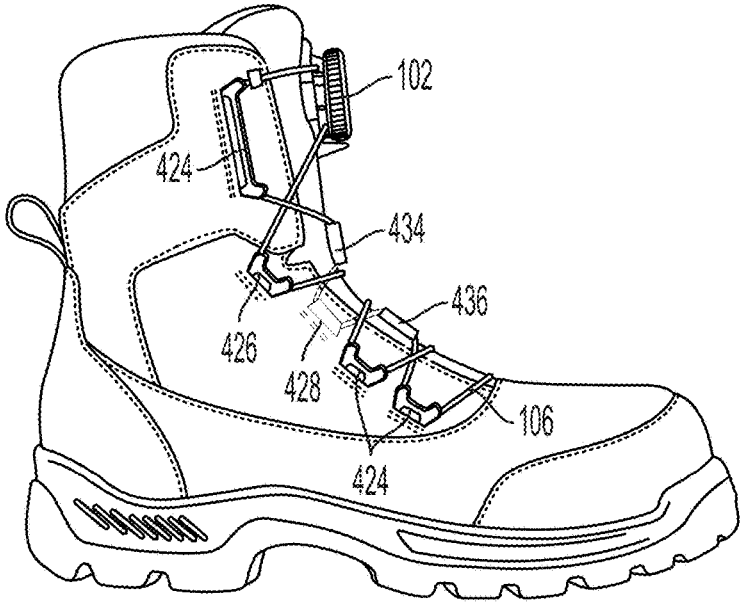
Figure 11B:
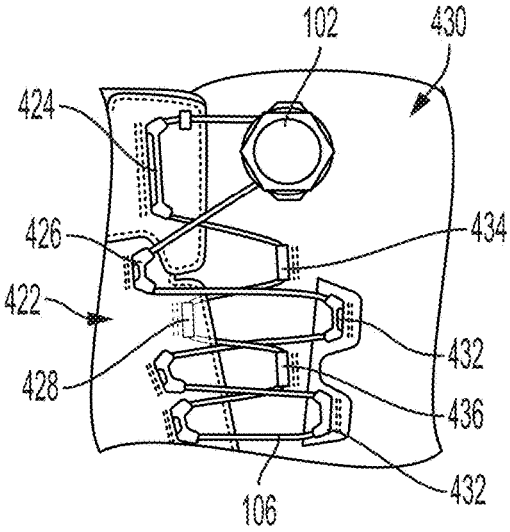
Figure 11C:
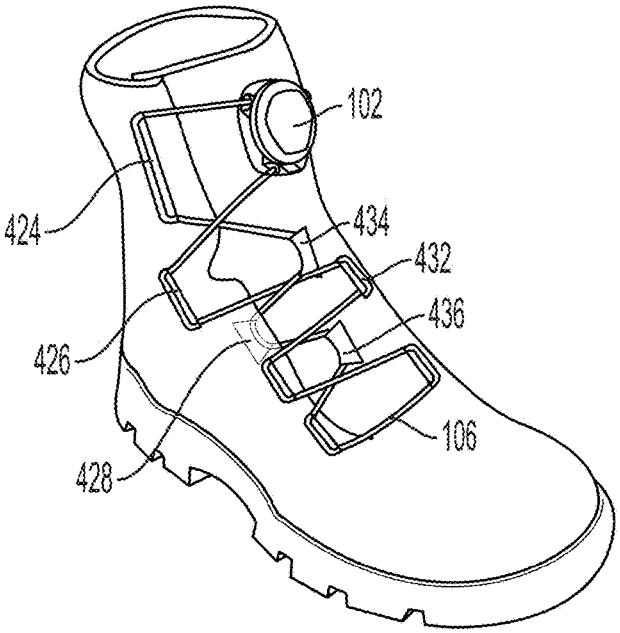

Referring to FIGS. 11A-C, illustrated is another embodiment in which the boot has an overlapping guide configuration that is achieved via asymmetrically located guides. The overlapping configuration is substantially similar to the overlapping configuration of FIGS. 10A-C. Specifically, the boot includes a proximal side 422 and a distal side 430 with a first proximal set of guides 424 positioned on the proximal side 422 of the boot and a first distal set of guides 432 positioned on the distal side 430 of the boot. The first proximal set of guides 424 is positioned along the proximal eyestay of the boot in a manner similar to the first proximal set of guides 404 of FIG. 10B. The first distal set of guides 432 are likewise positioned along the distal eyestay in a manner similar to the distal set of guides 412 of FIG. 10B.

A second proximal set of guides, 426 & 428, is also positioned on the proximal side 402 of the boot. The second proximal set of guides, 426 & 428, may be positioned asymmetrically in relation to the first proximal set of guides 424. Specifically, in some instances, an upper guide 426 of the second proximal set of guides may be positioned laterally outward from the proximal eyestay (see FIG. 11C), which may result in an increased rearward and downward tension being imparted on the boot as previously described. In other embodiments, the upper guide 426 of the second proximal set of guides may be roughly aligned with the proximal eyestay or with one or more lower guides of the first proximal set of guides 424 (see FIGS. 11A-B).

A lower guide 428 of the second proximal set of guides is positioned under the proximal eyestay near a lower guide of the first proximal set of guides 424. The lower guide 428 may be laterally offset from the proximal eyestay, roughly aligned with the proximal eyestay, or positioned laterally inward from the first proximal set of guides 424 as illustrated in FIG. 11B. The lower guide 428 is longitudinally offset from the lower guide of the first proximal guide set 424. The lower guide 428 may function with one or more guides of the first proximal set of guides 424 in a pulley like manner to create a snug fit of the boot about the lower portion of the wearer's foot.

A second distal set of guides, 434 & 436, are positioned on the distal side 430 of the boot asymmetrically in relation to the first distal set of guides 432. Specifically, an upper guide 434 and lower guide 436 of the second distal set of guides are positioned laterally inward from the distal eyestay so as to be positioned closer to a lateral center of the boot in comparison with the first distal set of guides 432. In some embodiments, either the upper guide 434 or lower guide 436, or both guides, may be positioned laterally outward from the distal eyestay. In the illustrated embodiments, neither the upper guide 434 nor the lower guide 436 are longitudinally aligned with a corresponding guide of the first distal guide set 432. The upper guide 434 or lower guide 436 may function with one or more guides of the first distal set of guides in a pulley like manner to create a snug fit of the boot about a mid-portion of the wearer's foot.

As illustrated in FIGS. 11B-C, the reel based closure device 102 is not centrally positioned between opposing guides. Rather, the reel based closure device 102 is positioned on the distal side 430 of the boot opposite to an upper guide of the first proximal set of guides 424. The tension member 106 is routed from the reel based closure device 102 so that an upper portion of the tension member 106 is routed directly to the upper guide of the first proximal set of guides 424 and so that a lower portion of the tension member 106 is routed directly to the upper guide 426 of the second proximal set of guides. In this manner, the reel based closure device 102 may create a slight asymmetric tension force in the tension member 106.

While several embodiments and arrangements of various components are described herein, it should be understood that the various components and/or combination of components described in the various embodiments may be modified, rearranged, changed, adjusted, and the like. For example, the arrangement of components in any of the described embodiments may be adjusted or rearranged and/or the various described components may be employed in any of the embodiments in which they are not currently described or employed. As such, it should be realized that the various embodiments are not limited to the specific arrangement and/or component structures described herein.

In addition, it is to be understood that any workable combination of the features and elements disclosed herein is also considered to be disclosed. Additionally, any time a feature is not discussed with regard in an embodiment in this disclosure, a person of skill in the art is hereby put on notice that some embodiments of the invention may implicitly and specifically exclude such features, thereby providing support for negative claim limitations.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. An article of footwear comprising:

a sole;

an upper coupled with the sole;

a tension member;

one or more guides that are coupled with the upper, the one or more guides being configured to route or direct the tension member along a path about the footwear;

a tightening mechanism that is operably coupled with the tension member such that an operation of the tightening mechanism tensions the tension member;

a panel having a fixed end that is attached to a first side of the upper, a main body that extends across a top of the upper toward a second side of the upper, and a free end that is opposite the fixed end; and at least one panel guide that is attached to an inner surface of the main body of the panel, the at least one panel guide being configured to route or direct the tension member along the path about the footwear;

wherein the panel is positionable over at least one guide of the one or more guides to cover and conceal the at least one guide from external view; and wherein the free end of the panel includes attachment means that are configured to releasably couple the free end of the panel with the second side of the upper.

2. The article of footwear of claim 1, wherein the at least one panel guide is arranged so that when the tension member is tensioned, the at least one panel guide pulls the panel into contact with a tongue or throat of the footwear.

3. The article of footwear of claim 1, wherein the at least one panel guide is positioned on the main body of the panel such that the free end of the panel is free of a guide for the tension member.

4. The article of footwear of claim 1, wherein the at least one panel guide is attached to the panel so that the at least one panel guide is positioned on the first side of the upper while the free end of the panel is positioned near the sole on the second side of the upper.

5. The article of footwear of claim 1, wherein the one or more guides comprises a guide member that is folded along a longitudinal length to form a loop or channel within which the tension member is insertable.

6. The article of footwear of claim 1, wherein the free end of the panel is releasably couplable with the upper.

7. An article of footwear comprising:

a sole;

an upper;

one or more guides that are coupled with the upper, the one or more guides being configured to route or direct a tension member along a path about the footwear;

a panel having a fixed end that is attached to a first side of the upper and a free end that is opposite the fixed end, the panel extending from the first side of the upper toward a second side of the upper; and at least one panel guide that is attached to an inner surface of the panel, the at least one panel guide being configured to route or direct the tension member along the path about the footwear;

wherein the panel is positionable over at least one guide of the one or more guides to cover and conceal the at least one guide from external view; and wherein the free end of the panel includes attachment means that releasably couple the free end of the panel with the second side of the upper.

8. The article of footwear of claim 7, wherein the one or more guides comprises a guide member that is folded along a longitudinal length to form a loop or channel within which the tension member is insertable.

9. The article of footwear of claim 7, wherein the article of footwear comprises a tightening mechanism that is operably coupled with the tension member such that an operation of the tightening mechanism tensions the tension member, and wherein the panel is positionable over the tightening mechanism to cover and conceal the tightening mechanism from external view.

10. The article of footwear of claim 7, wherein the at least one panel guide is attached to the panel so that the at least one panel guide is positioned on the first side of the upper while the free end of the panel is positioned near the sole on the second side of the upper.

11. The article of footwear of claim 7, wherein the at least one panel guide is arranged so that when the tension member is tensioned, the at least one panel guide pulls the panel into contact with a tongue or throat of the footwear.

12. The article of footwear of claim 7, wherein the article of footwear comprises an additional panel having a fixed end that is attached to the upper and a free end that is opposite the fixed end, and wherein the panel is positionable over the additional panel to cover and conceal at least a portion of the additional panel from external view.

13. A method of manufacturing an article of footwear, the method comprising:

providing the article of footwear, the article of footwear comprising:

a sole; and an upper;

coupling one or more guides with the upper, the one or more guides being configured to route or direct a tension member along a path about the footwear; and coupling a panel with a first side of the upper, the panel including at least one panel guide attached to an inner surface of the panel that routes or directs the tension member along the path about the footwear, the panel being oriented about the upper so that:

a distal end of the panel extends atop the upper toward a second side of the upper; and the panel is positionable atop the one or more guides to cover and conceal the one or more guides from external view;

wherein the distal end of the panel includes attachment means that are releasably couplable with the second side of the upper.

14. The method of claim 13, wherein the one or more guides comprises a guide member that is folded along a longitudinal length to form a loop or channel, and wherein the method further comprises inserting the tension member through the loop or channel of the guide member.

15. The method of claim 13, wherein the method further comprises attaching the at least one panel guide to the inner surface of the panel.

16. The method of claim 13, wherein the method further comprises attaching a tightening mechanism to the upper, the tightening mechanism being operably coupled with the tension member such that an operation of the tightening mechanism tensions the tension member, wherein the tightening mechanism is positioned such that the panel is positionable over the tightening mechanism to cover and conceal the tightening mechanism from external view.

17. The article of footwear of claim 1, wherein the panel is positionable over the tightening mechanism to cover and conceal the tightening mechanism from external view.

* * * * *